United States Patent [19]

Brandt et al.

[11] Patent Number: 4,498,326

[45] Date of Patent: Feb. 12, 1985

[54] APPARATUS AND PROCESS FOR FORMING ARTICLES BY HEADING

[75] Inventors: David S. Brandt, Oneonta; Samuel J. Costello, Nineveh, both of N.Y.

[73] Assignee: Allied Corporation, Morristown, N.J.

[21] Appl. No.: 499,103

[22] Filed: May 27, 1983

[51] Int. Cl.[3] ..... B21F 5/00

[52] U.S. Cl. ..... 72/318; 72/316; 72/354; 72/359; 72/294; 72/404; 10/12 R; 10/26

[58] Field of Search ..... 72/316, 294, 318, 354, 72/359, 353, 377, 404, 405, 306; 10/26, 13, 12 R, 47, 48

[56] References Cited

U.S. PATENT DOCUMENTS

| | | | |
|---|---|---|---|
| 1,983,618 | 12/1934 | Lamond | 72/318 |
| 2,442,142 | 5/1948 | Nettenstrom | 72/318 |
| 2,586,336 | 2/1952 | Huck | 72/354 |
| 2,705,333 | 4/1955 | Friedman | 72/354 |
| 3,124,876 | 3/1964 | Putetti | 72/354 |
| 3,253,287 | 5/1966 | Friedman | 72/354 |
| 3,301,033 | 1/1967 | Bignell et al. | 72/318 |
| 4,237,942 | 12/1980 | Dietrich | 72/318 |

FOREIGN PATENT DOCUMENTS

| | | | |
|---|---|---|---|
| 1112344 | 3/1956 | France | 72/354 |
| 305810 | 12/1936 | Italy | 72/267 |

*Primary Examiner*—Daniel C. Crane

*Attorney, Agent, or Firm*—J. R. Benefiel

[57] ABSTRACT

An apparatus (100) and process for multistep heading of elongated stock to form a brush contact (10) with a relatively great reduction in the length of the wire stock material (386) achieved during successive heading steps, including a rotary holder plate (112) mounting a series of blank clamping holders (166) indexed through a series of stations and a series of coning dies (240) and punches (244) carried by independently actuated tooling plates (114, 116) which are axially advanced during forming of the blanks. A final forming step involves a reverse extrusion to create an endwise axial opening (26). The apparatus (100) also includes a feed mechanism (148) and a cutoff mechanism (160) for forming blanks from wire stock (386). A clamping member (178) is associated with each holder (166) for clamping the blank for securement during the forming steps, which is unlocked at an ejection station to enable removal of the formed article by an ejection mechanism (610). A broken tool detector (712) is also provided located at the station preceding the ejection station.

20 Claims, 37 Drawing Figures

APPARATUS AND PROCESS FOR FORMING ARTICLES BY HEADING

This invention relates to an apparatus and process for forming articles by heading, particularly contact components for electrical connectors. This invention more particularly relates to an apparatus and process for forming components for brush contacts. Such components consist of a relatively elongated forward pin section with a substantially larger diameter brush-receiving rear section having an endwise opening or socket receiving the brush wire contacts. Such brush wire contacts are well known and consist of a number of fine diameter wires which are inserted into the opening and then secured as by crimping. Such contact components also include an intermediate shoulder formed with relatively sharp corner for locating the contact within the electrical connector assembly, as is well known to those skilled in the art.

These contact components are constructed of relatively malleable conductive material such as various copper alloys in order to enable crimping of the brush contacts within the socket. A critical manufacturing consideration is the need to maintain reasonably precise concentricity between the diameters of the various sections for proper functioning of the assembled electrical connector.

An additional consideration is the need for a chamfer at the mouth of the socket such that the brushes may be reliably inserted thereinto during manufacturing.

Heretofore, the conventional method of manufacturing such brush contact components has involved machining blanks of solid stock material. This is a relatively costly process due to the low production rate of the machining process, and also results in waste of the material which is machined away to form the article.

Cold heading has long been used to manufacture elongated headed parts such as bolts, screws, etc. and offers the advantage of much higher production rates for typical processes and apparatus. Heading also produces superior strength characteristics of the formed articles due to the grain structure caused by the direction of flow during the heading process, and eliminates the waste of material inherent in machining.

Such cold heading has not been successfully utilized for the manufacture of brush contacts, primarily because the substantial difference in the diameters of the socket and the pin sections of the contact require a great length of wire stock to be headed in proportion to its diameter, i.e., a 16.5 to 1 ratio would commonly be required. Such ratios have heretofore not been attempted in the cold heading art, 6.5 to 1 being a typical maximum ratio.

A further problem is involved in the need to maintain relatively precise concentricity between the various diameters, difficult to achieve by conventional cold heading processes.

Also, such contacts are often made with varying pin section lengths and any manufacturing process should desirably allow for variations in the pin section length without necessitating retooling of the machine, or providing a totally separate machine.

DISCLOSURE OF THE INVENTION

The present invention involves an improved apparatus and process for forming headed articles utilizing independently controlled axially movable first and second tooling plates carrying coning dies and punches respectively, which are arranged circumferentially in an angularly spaced series of work stations. The tooling plates are driven to be axially advanced and retracted against a rotary holder plate carrying a corresponding series of holders which are adapted to receive the ends of heading blanks. The blanks are formed by severing lengths of elongated wire stock material which is received from a feed mechanism and inserted into each holder as the rotary holder plate rotates each holder through a load station. Each blank is incrementally cycled through each of a series of forming work stations, whereat each of the coning dies is initially advanced over the protruding end of the blank, and into engagement with a cavity formed in the faces of the holders. Each of the punches is subsequently advanced into engagement with the blanks to progressively carry out the heading process. Tooling in the last forming work station executes a reverse extrusion to form the sockets in the large diameter end of the formed holder.

The next work station includes a detector for detecting broken punches, while the formed contact components are ejected at the last station.

The mechanism features simple, mechanical, cam driven motions which are adjustable to obtain precise control.

The feed mechanism includes an adjustable stroke pitman driving a movable carrier, the carrier receiving the wire stock, which wire stock is clamped thereto to enable it to be fed through a stationary clamp. The wire stock is also fed through a cut off die set carried by the first tooling plate, and thence into each holder, which are each moved into position at the load station with indexing of the rotary holder plate. The adjustable pitman feed stroke allows for varying pin length sizing of the formed contact components, by feeding different lengths of wire into the holders.

The stationary clamp and the holder in the load station are each unlocked and locked by cam mechanisms to first allow wire stock to be admitted and then the wire stock clamped just prior to cut off by the cutoff die set.

The coning dies and punches are carried by the first and second tooling plates, respectively which are independently cam driven, to allow for a much greater stroke of the coning dies than the punches, enabling a relatively great length of the wire stock to be head formed in comparison to its diameter, i.e., 16.5 ratios may be easily achieved in a four blow process.

After the forming stroke, the coning dies are withdrawn prior to withdrawal of the punches, during the retraction cycle, and the punches maintained in engagement therewith to prevent the formed pieces from being stripped from the holders. The punches however, are initially slightly withdrawn immediately prior to the withdrawal of the coning dies to relieve the forming pressure, and insure that size changes do not occur as the coning dies are withdrawn.

The coning dies each have pilot sections which are received over complementary portions of the holders to insure good alignment therebetween.

Resilient spacers locating the coning dies allow full seating of the coning dies against the holder faces, and insure a sealed die cavity, formed by the coning die opening and a counterbore formed in each holder.

Each holder consists of split halves with aligned grooves together forming a holder opening adapted to be opened and closed to receive the blanks and release the formed articles.

This arrangement has the advantage of enabling a relatively great length of wire stock to be head formed to allow typical brush contacts to be readily formed by upset of wire stock of the diameter of the pin section. At the same time, precise concentricity between the various diameters of the formed article is achieved.

This head forming process achieves an increased rate of production and the elimination of the loss of machined material, and also creates an article having the superior grain structure characteristic of headed articles.

The apparatus is relatively reliable in operation and maintains accuracy over extended manufacturing cycles, such as to be well suited for high speed volume production of such articles.

DETAILED DESCRIPTION

DETAILED DESCRIPTION

Figure 1:
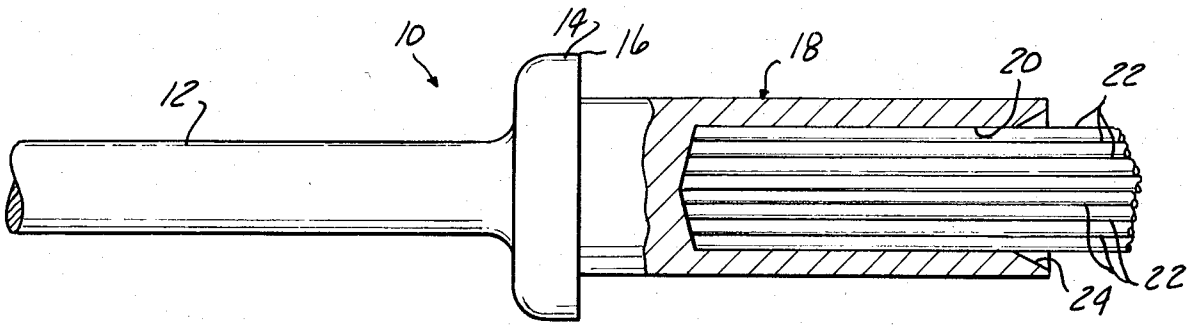
FIG. 1 is an enlarged, fragmentary, partially sectional view of a brush contact of the type manufactured by the apparatus and process according to the present invention.

FIG. 1 illustrates a fragmentary view of a brush contact 10, having a reduced diameter tail or pin section 12 which typically is of varying length and adapted to be received within a connector body, (not shown) and utilized to establish an electrical connection in the manner well known to those skilled in the art.

A larger diameter shoulder 14 is provided which includes a relatively sharply squared corner 16 at the forward face thereof used to provide an accurate location of the contact 10 within the connector body. A rear portion 18 is also provided having an axially extending opening formed in one end to provide a socket 20 to receive the brush wires 22 received therein and retained as by an inward crimping of the outer wall. The periphery of the end of socket 20 is chamfered at 24 in order to insure reliable insertion of the brush wire 22 during manufacture.

There are several features of such brush contacts 10 which are important considerations in their manufacture. firstly, the concentricity of the various diameters, i.e., the shoulder 14, tail 12, and rear section 18 must be relatively precise for proper assembly and functioning of the brush contact in the electrical connector.

Secondly, since there is relatively great difference in diameter in the shoulder 14, tail 12 and the rear section 18, manufacturing by heading is a relatively difficult process, particularly since the pin section 12, which is of the smallest diameter may vary in length considerably and may comprise a considerable proportion of the contact length compared to the remainder of the sections of the contact 10. It would be advantageous to head form wire stock of the diameter of the pin section 12 to create the rear section 18, but this would require a relatively great length of the wire stock in comparison with its diameter to be formed. This ratio has been limited to an approximate maximum of 6.5 to 1 in prior art apparatus, and this has been achieved only in multiple blow machines.

Thirdly, the uniformity and consistency in forming the chamfer 24 is important to achieving reliable assembly of the brush wires 22.

According to the present invention, such contacts are manufactured by apparatus including a plurality of circumferentially spaced series of holders, arranged about the axis of a rotary holder plate in correspondence with a plurality of work stations. Each holder is formed with a holder opening and clamping means is associated therewith which is operated to allow wire stock to be inserted by a feed and cutoff mechanism at one of the work stations comprising a load station. The clamping means is subsequently operated to grip the end of the wire stock, with a section thereof protruding therefrom. The portion retained within the holder is of a diameter to comprise the pin section of the contact. The rotary holder plate is then indexed to advance the retained wire stock blank successively through the next several work stations whereat head forming steps are performed on the protruding length of the blank.

The head forming at each forming station is achieved by separately controlled, independent advance of a coning die and punch. Each coning die has a die opening moved over the protruding length of the wire stock blank to contact an opposing face of the holder. A subsequent advance of a punch into the opposite end of the die opening and into contact with the end face of the blank end face forces the material of the wire stock into contact with the interior surface of the coning die opening, and thus achieves head forming thereof.

Each holder is formed with a counterbore adjacent the end face contacted by the coning die end face such that the brush contact shoulder 14 is formed by heading of the blank material into the space of the counterbore at successive stations.

At the final forming work station, a reverse extrusion process is carried out by a reduced diameter punch which engages the face of the partially formed blank, causing a reverse extrusion thereof to form the socket 20 of the brush contact 10.

This process is carried out at each station by axial advance and retraction of first and second tooling plates respectively carrying the coning dies and punches with intermittent indexing of the rotary holder plate providing the successive head forming of each blank carried by the rotary holder plate.

A subsequent initial slight retraction of the punch tools relieves the forming pressure, particularly, significant at the station at which reverse extrusion forming is carried out.

The coning dies are then retracted with the punches still substantially in position against the endfaces of the formed blanks, to prevent stripping them from the respective holders by the retraction of the coning dies.

The forming process is depicted diagrammatically in FIGS. 2A–2F and 3A–3G.

Figure 2A:
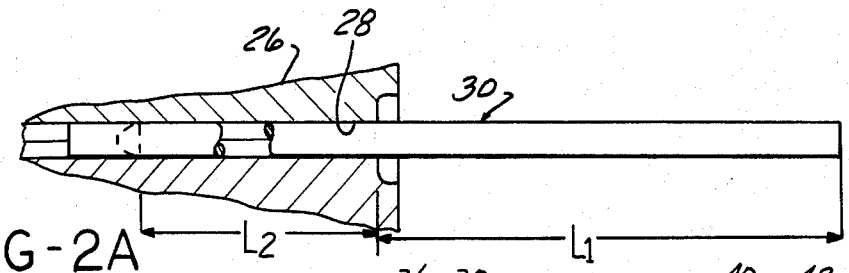
FIGS. 2A through 2F are diagrammatic representations of the successive steps in the head forming process according to the present invention.

In FIG. 2A the holder means 26 is shown having an opening 28 into which is received a length of wire stock 30, which, as will be described hereinafter, is inserted by means of a feed-cutoff mechanism, the wire stock received from a straightener.

The cutoff mechanism severs a predetermined length of the wire stock at a point which leaves a predetermined length L1 protruding from the holder 26. The predetermined length L2 of wire stock retained with the holder means 26 corresponds to the pin section 12 of the brush contact 10 to be formed. As will be described hereinafter, the length L2 may be readily varied over a considerable range by an adjustment in the stroke of the feed mechanism to enable a range of sizes to be formed by the same apparatus without tooling changes, whereas the length L1 may be precisely adjusted to ensure a highly consistent length. This precision is significant so that the chamfer 24 can be consistently and accurately formed by the reverse extrusion forming step described herein.

Clamping means associated with the holder 26, not depicted in FIG. 2A, securely retains the blank section 30 within opening 28.

Figure 2B:
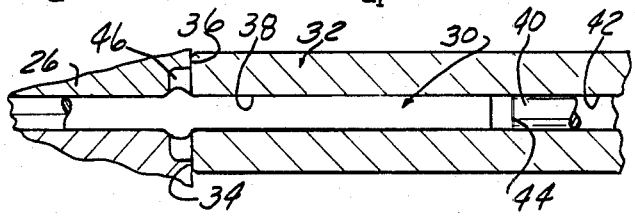

As can be seen in FIG. 2B, a first coning die 32 is shown having been advanced to bring an endface 34 against the opposing endface 36 of the holder 26. The coning die 32 has a tapered die opening 38 formed therein, which receives the protruding section of the blank 30 thereinto. The initial forming step is shown completed by the subsequent advance of the first punching tool 40 within an end opening 42 of the coning die 32, axial advance against the endface 44 of the blank section 30 causing a shortening of the length of protruding blank 30 and forcing the material outwardly into contact with the surface of the coning die opening 38.

It will be noted that the holder 26 is formed with a counterbore 46 extending into the surface 36 against which the coning die face 34 is brought into abutment to partially define the die opening. This counterbore 46 causes shoulder 14 to be formed in stages by progressive radial bulging of the blank section 30 located immediately adjacent the counterbore 46.

Figure 2C:
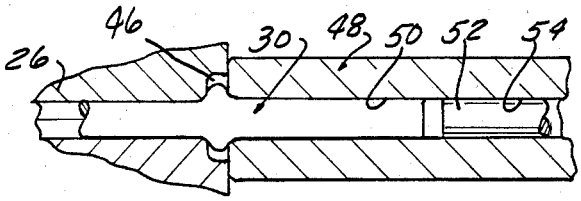
Figure 2D:
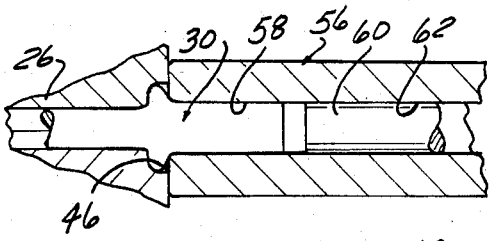
Figure 2E:
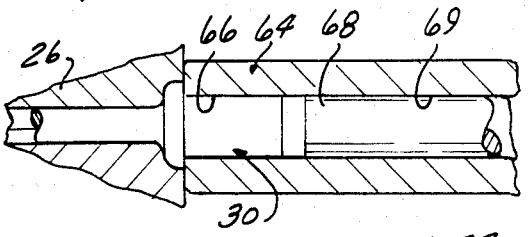

This process is continued through successive forming steps shown in FIGS. 2C, 2D, and 2E, through which each of the holders 26 are successively advanced.

In FIG. 2C a coning die 48 having a large diameter and shorter length of the tapered opening 50 receives the partially formed blanks 30 from the previous step, with a punch 52 advanced within a coning die guide opening 54 in similar fashion to shorten and increase the diameter of the now partially formed blank 30, also increasing the radius of the bulge within the counterbore 46 of the holder 26.

Similarly in FIG. 2D, a coning die 56 having a shorter tapered opening 58, receives the partially formed blank 30, with a punch 60 of increased diameter received in a guide opening 62 advanced thereagainst as shown, to further shorten and thicken the protruding section of the blank 30 and substantially fill the counterbore 46.

FIG. 2E completes the head forming process, with a coning die 64 having an opening 66 of increased diameter with a punch 68 advanced within rear opening 69 of the coning die 64.

Figure 2F:
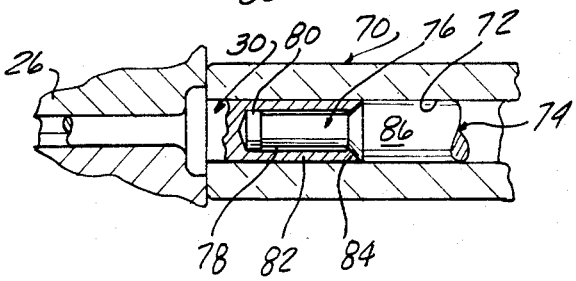

In FIG. 2F the socket 20 is formed by a coning die 70 having a straight sided opening 72 over the formed end of the blank 30, and punch 74 having a forward section 78 of substantially lesser diameter than the die opening 72. Punch formed section 76 has a slightly relieved diameter 78 to the rear of the forward land section 80. Forming punch 74 is brought into engagement with the rear face of the substantially formed blank 30 and advanced to cause a reverse extrusion of blank material 82 over the outside of the punch 74. Chamfered shoulder 84 forms a transition to the full diameter rear section 86 slidably received within die opening 92, and causes forming the chamfer 14 at the rear face of the brush contact 10.

It is to be understood that each of the successive stages of process depicted in FIGS. 2A–2F are contemplated as being performed by means of a rotary holder plate having a number of holders 26 which are each successively rotated or transferred through a series of angularly spaced locations each defining a work station whereat the various forming steps depicted in FIGS. 2B–2F are carried out. Thus, each of the forming steps shown in FIGS. 2B–2F are simultaneously performed on respective one of a series of partially formed blanks 30, each held in one of a series of holders 26 as will be described below in detail in describing the heading apparatus.

Figure 3A:
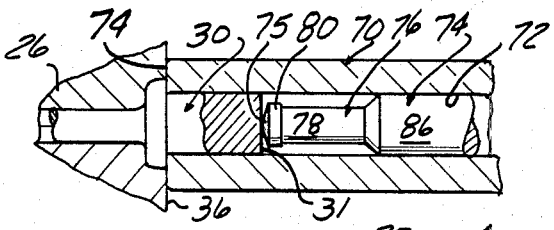
FIGS. 3A through 3G are diagrammatic representations of the successive stages in the final forming step shown in FIG. 2F.

FIGS. 3A through 3G depict the reverse extrusion forming step shown in FIG. 2F at various stages, beginning with the initial stage shown in FIG. 3A, during which end face 74 of coning die 70 is advanced into abutment with the surface 36 of the aligned holder means 26.

As shown, the punch 74 has also been advanced to the position with the leading end 75 brought into engagement with the end face 31 of the partially formed blank 30.

Figure 3B:
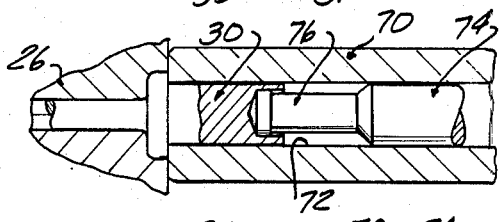
Figure 3C:
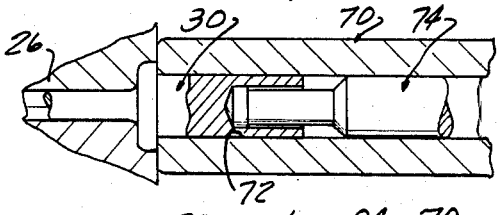

As the die 70 is advanced, as shown in successive stages in FIGS. 3B and 3C, the outer layer of material of the partially formed blank 30 is rearwardly extruded, confined within the opening 72 of the coning die 70, thereby creating the socket 20.

Figure 3D:
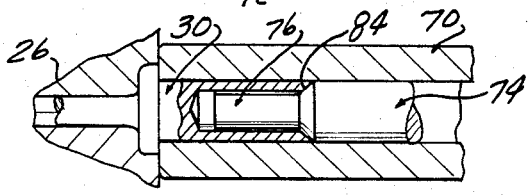

At the completion of the reverse extruding process, as shown in FIG. 3D, the shoulder 84 of punch 74 receives the rearwardly flowing blank material, to form the chamfer 24 on the rear end of the socket 20 of the brush contact 10 as described above.

It can be seen that a precise control over the length of the protruding portion of blank 30 is necessary in order to provide a completely formed chamfer 24, while avoiding damage to the tooling. This may be ensured as will be described hereinafter, by means of an adjustability of the feed mechanism which advances the blank 30 into the holder 26 in the initial step, as well as an adjustment of the cut off mechanism associated therewith.

Figure 3E:
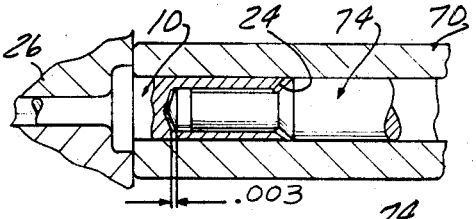

After completion of the forming step, the punch 74 is withdrawn very slightly, (i.e., 0.003 inches) to relieve the forming pressure as shown in exaggerated form in FIG. 3E.

Figure 3F:
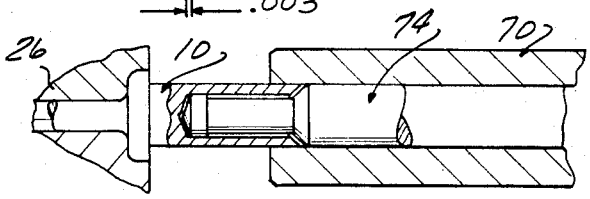
Figure 3G:
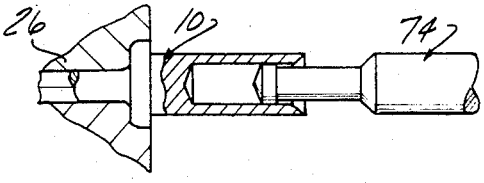

Thereafter, the punch 74 is maintained in position as the coning die 70 is withdrawn, as shown in FIG. 3F, such that the presence of the punch 74 precludes stripping of the completed brush contact 10 from the holder 26.

The procedure of relieving the forming pressure of the punch 74 and first withdrawing the coning die 70, also ensures that the outside diameter of the brush contact holder 10 does not grow slightly as the coning die 70 is withdrawn.

Figure 4:
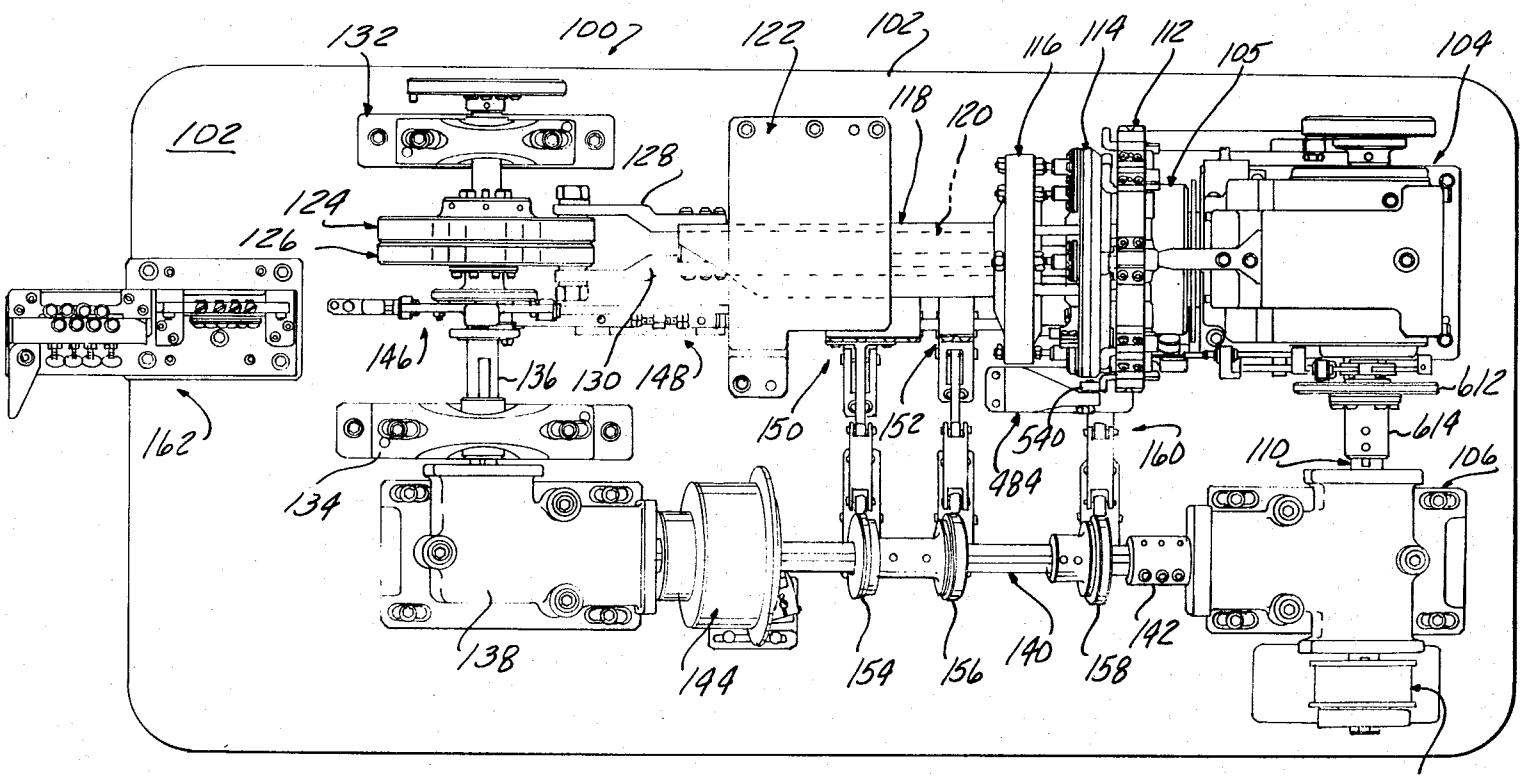
FIG. 4 is a plan view of the apparatus according to the present invention.
Figure 5:
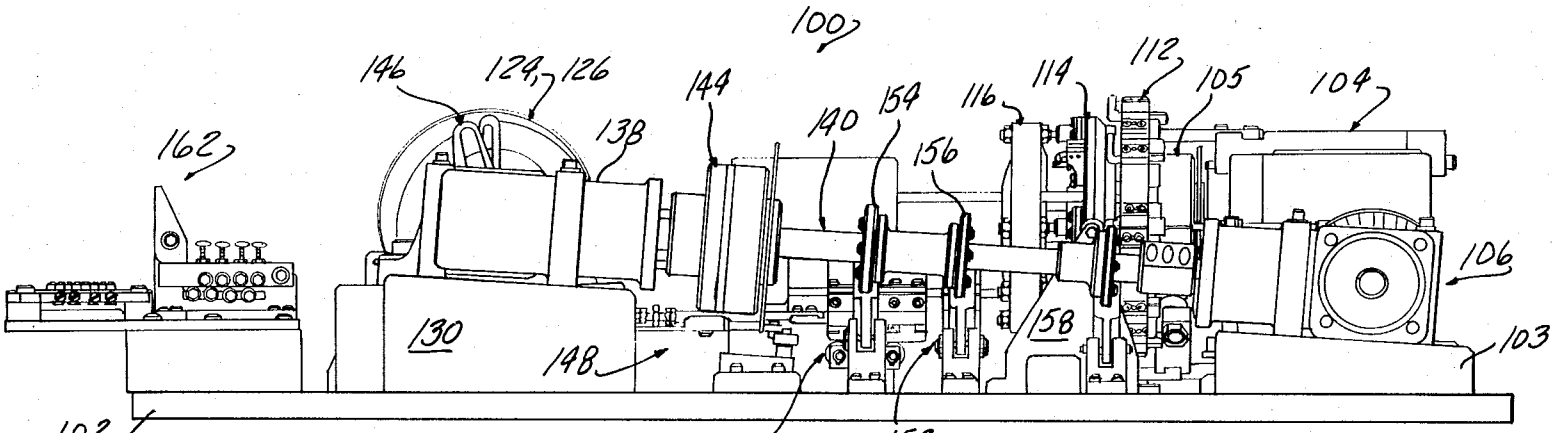
FIG. 5 is an elevational view of the apparatus according to the present invention, as shown in FIG. 4.

The heading apparatus 100 is depicted in FIGS. 4 and 5, with the various components thereof mounted to a base plate 102, which in turn is mounted on a machine base (not shown). The major components include an indexing drive 104 mounted to the base plate 102, which is adapted to receive rotative power from a right angle drive 106, also mounted to the base plate 102 as shown, in turn driven via pulley 108, adapted to be driven by an electric motor drive (not shown).

A drive shaft 110 extends between the right angle drive 106 and the indexing drive 104 to transfer rotary power. The indexing drive 104 is of a type well known and commercially available, adapted to produce an indexing or incremental rotation of a rotary holder plate 112 through a drive clutch 105.

The rotary holder plate 112 is located aligned with and opposite a first tooling plate 114, carrying the coning dies, and a second tooling plate 116 carrying the punches, each tooling plate 114 and 116 axially spaced from the rotary holder plate 112, and from each other.

The first and second tooling plates 114 and 116 are rotatably fixed while being mounted for advancing and retracting axial motion, in order to perform the heading forming steps as described above. For this purpose axial extension members 120 and 118 are provided connected respectively to first and second tooling plates 114 and 116. Extension members 118 and 120 each extend through a main support assembly 122 mounted to the base plate 102, drivingly connected respectively to one of a pair of rotary cams 124 and 126 by means of actuator arms 128 and 130 respectively, providing means for causing the axial advancing and retracting motion of the first and second tooling plates 114 and 116 respectively.

Suitable rotary bearing assemblies 132 and 134 are mounted to the base plate 102 as shown supporting rotary cams 124 and 126 and a cross drive shaft 136 which rotates the rotary cams 124 and 126. Rotary power therefor is received from a right angle drive unit 138 mounted atop the base plate 102, which in turn receives rotative power via a drive shaft assembly 140 coupled at 142 to an output of the right angle drive 106. A limited slip clutch 144 is provided to protect against overload.

Drive shaft 136 also drives an adjustable pitman assembly 146, which in turn drives a wire stock feed mechanism indicated generally at 148. The feed mechanism 148 includes a linearly movable carriage 150, which is clamped and unclamped to the wire stock by operation of a cam 154 driven by drive shaft 140.

A stationary clamp 152 is also provided, operated by cam 156, also driven by the drive shaft assembly 140, which staionary clamp 152 intermittently grips the wire stock during the feed and cutoff operations as will be described in detail. A cutoff mechanism 160 is operated by a cam 158, also driven by the drive shaft 140.

For the specific embodiment described, the blanks may be provided by copper alloy wire stock and the feed mechanism 146 thus is adapted to receive indeterminate lengths of straightened wire stock of an appropriate gauge from a straightening mechanism 162, also mounted atop the base plate 102 aligned with the feed mechanism 148. Such wire straightening devices are well known and are available commercially and a detailed description will not be hereinafter included. Suffice it to say, wire stock may be received from a supply reel, and be straightened thereby to form elongated blank material.

A detailed description of the right angle drives 106 and 138, indexing drive 104, clutch 105, and overload clutch 144 is also not here included since such devices are well known to those skilled in the art, and suitable commercial units are readily available for incorporation in the apparatus of the present invention.

Figure 6:
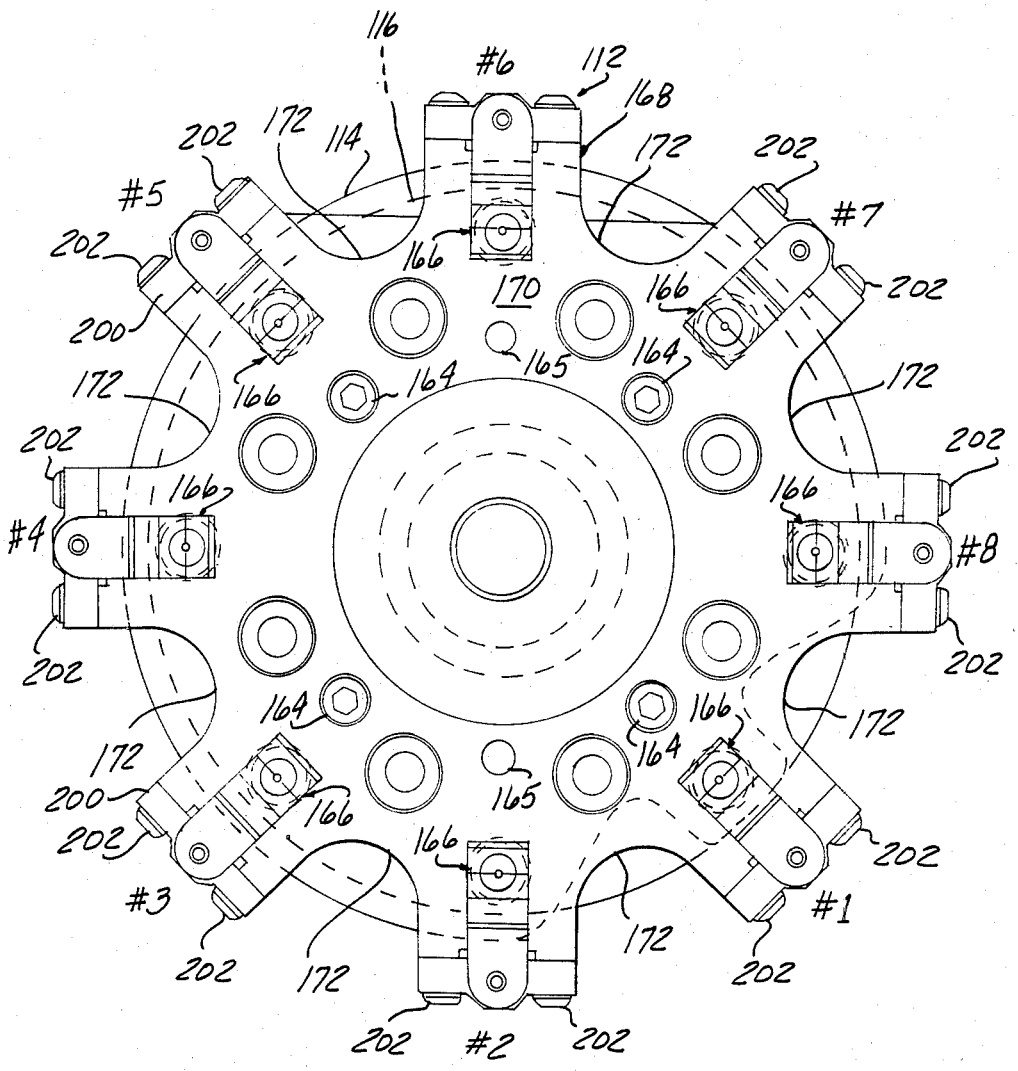
FIG. 6 is an endwise view of the rotary holder plate and first and second tooling plates incorporated in the apparatus of FIGS. 4 and 5.

FIG. 6 shows the rotary holder plate 112 in alignment with the first tooling plate 114 and second tooling plate 116. The rotary holder plate 112 is secured to the clutch 105 by means of cap screws 164 such as to be rotated by the indexing drive 104 between eight equally spaced angular positions.

Dowels 165 are provided for precise angular location of the rotary holder plate member 170 to the clutch 105 thereby insuring precise angular location with the indexing drive unit 104.

In correspondence therewith, there are provided eight angularly spaced holder assemblies 166 mounted to eight protuberances 168 formed on a rotary holder plate member 170, the eight protuberances 168 are formed by relieved areas 172 machined thereinto at locations spaced about the circumference of the rotary holder plate 170 to lighten the plate member 170.

Each of the annular positions through which the holder assemblies 166 are incrementally advanced define a series of eight work stations, #1–#8, as indicated in FIG. 6.

The #1 work station consists of a blank load station whereat the feed mechanism 148 and cutoff mechanism 160 cooperate, as will be described hereinafter in detail, to cause an unformed blank to be loaded into the holder 166 which is located at the #1 or load station.

The heading forming steps are executed on the blank secured within the holder means 166 located at work stations #2–#6, with progressive forming of each blank achieved by indexing of the rotary holder plate 112 through these stations.

In each of work stations #2–#6, there is aligned the heading tooling sets carried by first and second tooling plates 114 and 116, each of which are mounted in alignment with the rotary holder plate 112. Each of the holders 166 is thus successively brought into alignment with each tooling set as the rotary tool plate 112 is indexed.

Work station #7 consists of a tooling inspection station, whereat the presence of a broken punch within a formed contact 10 is detected by a detector assembly also to be described hereinafter.

Station #8 comprises the unload or eject station whereat the completed brush contact 10 is ejected from the holder 166 at that station, by an ejection mechanism to be described hereinafter.

Figure 7:
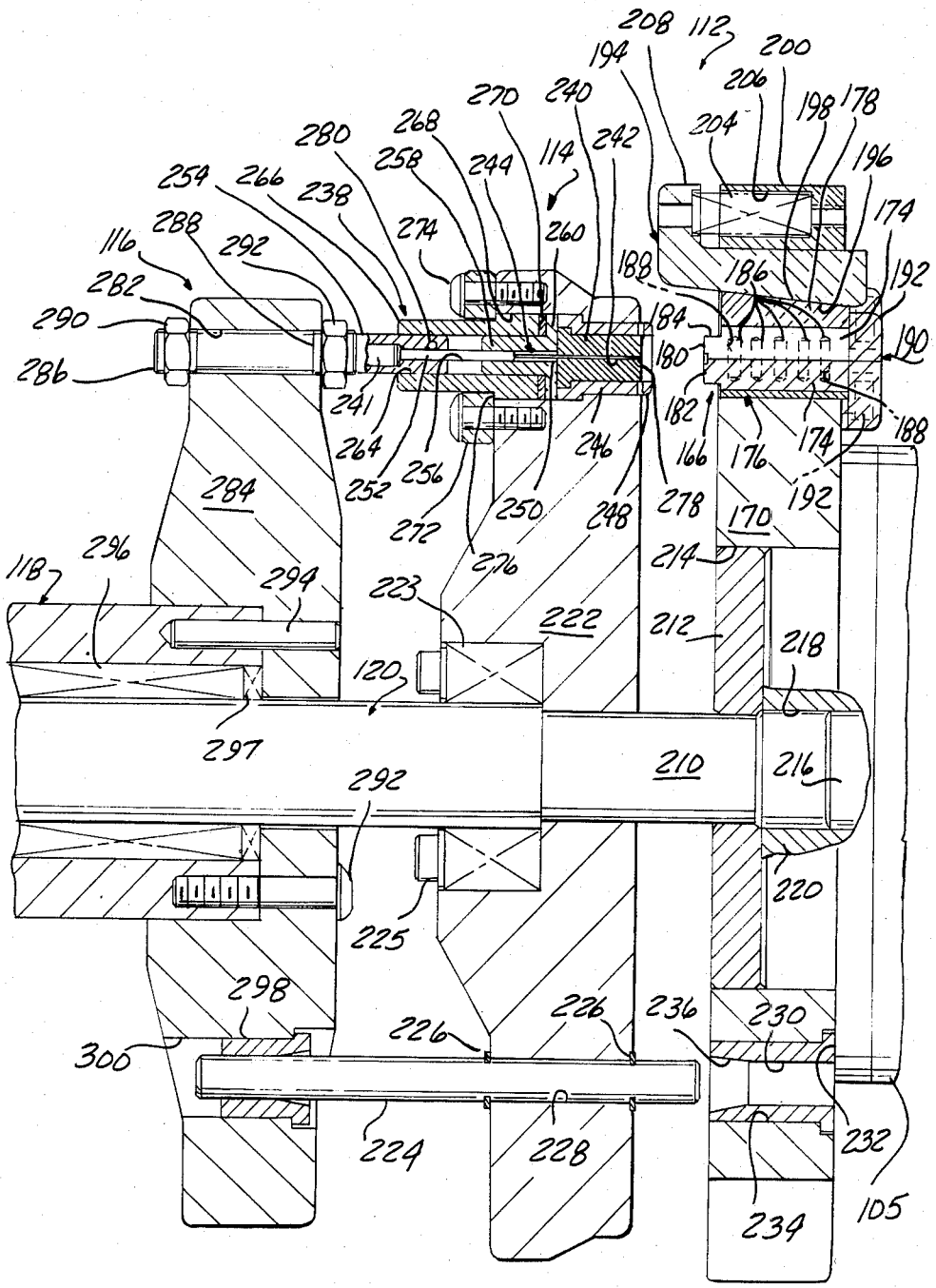
FIG. 7 is an enlarged partially sectional side elevational view of the first and second tooling plates and rotary holder plate shown in FIGS. 4, 5 and 6, shown in the separated, retracted position.

FIG. 7 shows the details of each holder 166, which are each comprised of split halves 174, mounted on rotary holder plate member 170 between a wear plate 176 and a tapered plate 178. Each of the split halves 174 is formed with a longitudinal groove aligned so as to together define the holder opening 180 extending therethrough with a counterbore 182, located at the end face protruding from the holder plate member 170 and opposite the first tooling plate 114. It can also be seen that the halves 174 each are formed with a protruding section 184 which together form a pilot for alignment of the respective holder 166 with the coning dies in the first tooling plate 114 as will be described hereinafter.

The halves 174 are urged apart by means of a series of compression springs 186, which are received into aligned opposing pockets 188 in each of the halves 174. Accordingly, the split halves 174 are normally biased apart to a slightly separated position which establishes clearance sufficient for the wire stock to be inserted, and the formed articles to be ejected.

The halves 174 are retained by retainer piece 190 secured by means of cap screws 192 to the rear face of the rotary holder plate member 170 as shown. Taper member 178 comprises clamping means lying atop the outer split half 174, which cooperates with clamp operator means generally consisting of a tapered locking member 194 which is mounted with tapered surface 196 overlying the upper tapered surface 198 of the taper member 178. The tapered locking member 194 is retained by an end cap 200, with cap screws 202 securing the same to the rotary holder plate member 170 and thus securing the tapered locking member 194.

A compression spring 204 is received within a pocket 206 in end cap 200, and pocket in 194, and acts against an upper ear 208 of the tapered locking member 194 urging it outward or to a locking position. The degree of taper of surfaces 196 and 198 is such that upon axial movement of the taper locking member 194 into a locking position, a self-sustaining frictional lock will result, securing the split halves 174 in a compressed or holder clamped position until the tapered locking member 194 is moved axially the opposite direction against the bias of compression spring 204 to a release position.

Alignment of the rotary holder plate member 170 with the first tooling plate 114 is assured by being rotatably mounted on a pilot section 210 of the extension member 120 which is received within a bushing 212 received within a bore 214 of holder plate member 170. A pilot section 216 of the rotary index drive 104 is received in turn within a bore 218 of pilot extension 220 of the clutch 105.

The first tooling plate 114 includes a first tooling plate member 222 secured to the extension shaft 120 by means of a locking member 223 and cap screws 225.

Elongated dowel members 224 are also provided about the circumferentially spaced positions retained within the first tooling plate 222 by snap retainers 226 received therein in bores 228. The dowels 224 each include a protruding section which is adapted to be received within a bore 230 of a guide bushing 232 mounted in corresponding circumferentially spaced locations within bores 234 machined into the rotary holder plate member 170. Each of the guide bushings 232 are provided with a tapered lead section 236 such as to provide an approximate location of the rotary plate holder plate 112 and the first tooling plate 114 upon axial advance of the first tooling plate 114 towards the rotary holder plate 112.

A coning die assembly 238 is provided at each circumferential location corresponding to work station #2–#6 about the axis of first tooling plate member 222. Each coning die assembly 238 includes a coning die 240 having an appropriately configured coning die opening 242.

It will be understood that the precise configuration of opening 242 will depend on the particular heading operation and the article to be formed, but the opening of each coning die assembly 238 will be of reducing length and of increasing diameter at each of the respective work stations #2–#6.

The rear section of the coning die opening 242 accommodates a respective punch 244 mounted on the second tooling plate 116 as will be described hereinafter.

Each coning die 240 in turn is mounted within the coning plate guide 246 having a protruding pilot section 248 which is adapted to receive the pilot section 184 of the corresponding split halves 174, for accurate guidance and alignment upon initial axial forward movement of the first tooling plate 114. This insures proper concentricity of the respective openings and corresponding concentricity of the formed articles.

Each of the punches 244 includes a reduced diameter forward portion received within the coning die opening 242 and a larger diameter body section 252 carried by a punch holder 254. The forward section of the body section 252 is received within a bore 256 of a spacer member 258 having a flange portion 260 abutting the rear of coning die 240. The punch holder 254 is received within a bore 264 of a punch holder guide 266, the punch holder guide 266 being received within the first tooling plate member 222 within a bore 268 which also receives the take-up sleeve 258, with the forward face thereof in abutment against an annular resilient take-up pad 270 located adjacent the flange 260 of the take-up sleeve 258 and the forward face of the punch holder guide sleeve 266.

A retainer plate 272 is secured to the rear face of the first tooling plate member 222 by series of cap screws 274 engaging a shoulder 276 on the punch holder guide sleeve 266 to slightly compress the resilient pressure pad 270. The function of the resilient take-up pad 270 is to take up slight axial differences in location of the forward face 278 of each of the coning dies 240 as they move into abutment with the forward face of the split halves 174 of each of the respective holder 166 during a forming cycle, and also to ensure a firm abutment of the forward face 278 against the split halves 174. A tight engagement is necessitated since the interface partially defines the head forming die cavity, together with the counterbore 182, such that any slight clearance would tend to produce irregularities in the formed articles.

Thus, the compressibility of each pad 270 insures abutment of each coning die 240 face against a respective holder 166 by allowing for slight overtravel of the tooling plate 114 as the surfaces 278 of those coning dies 240 which are slightly ahead of other of the coning dies 240 move into abutment with the respective holders means 166.

The second tooling plate 116 carries the punch holder 254, and its axial motion causes the axial advance and retraction of the punches 244. The punches 244 are secured by means of dowels 280 extending through a corresponding drill opening in the holders 254 and retaining the body section 252 of the punch 244. The punch holder 254 is received within a corresponding bore 282 located at the center line of each work station, circumferentially spaced about the axis of the second tooling plate member 284. The axial position of the punch 244 may be adjusted by means of threaded sections 286 and 288 formed on the exterior of the punch holder 254, threadably engaged by adjustment nuts 290 and 292 in engagement with the respective opposing faces of the second tooling plate member 284.

The second tooling plate member 284 is secured to the second tooling plate extension member 118 by means of cap screws 292 with the precise angular position controlled by means of dowels 294 inserted axially through the central hub portion of the second tooling plate member 284 and endwise into the axial extension member 118. A thrust bearing 296 is also provided which engages the exterior of the extension shaft 120 accommodating the frictional loads as the extension members 118 and 120 are axially advanced and retracted.

Each of the dowels 224 is received within a bushing 298 received in a series of machined openings 300 circumferentially spaced about the periphery of the second tooling plate member 284. Dowels 224, together with the engagement of the coning die guide 246 over the pilot section 184 of the split die halves provides very accurate control over concentricity and alignment of each of the coning dies openings 242 with the holder openings 180. This insures good concentricity of the sections of the articles formed by the present apparatus.

Figure 8:
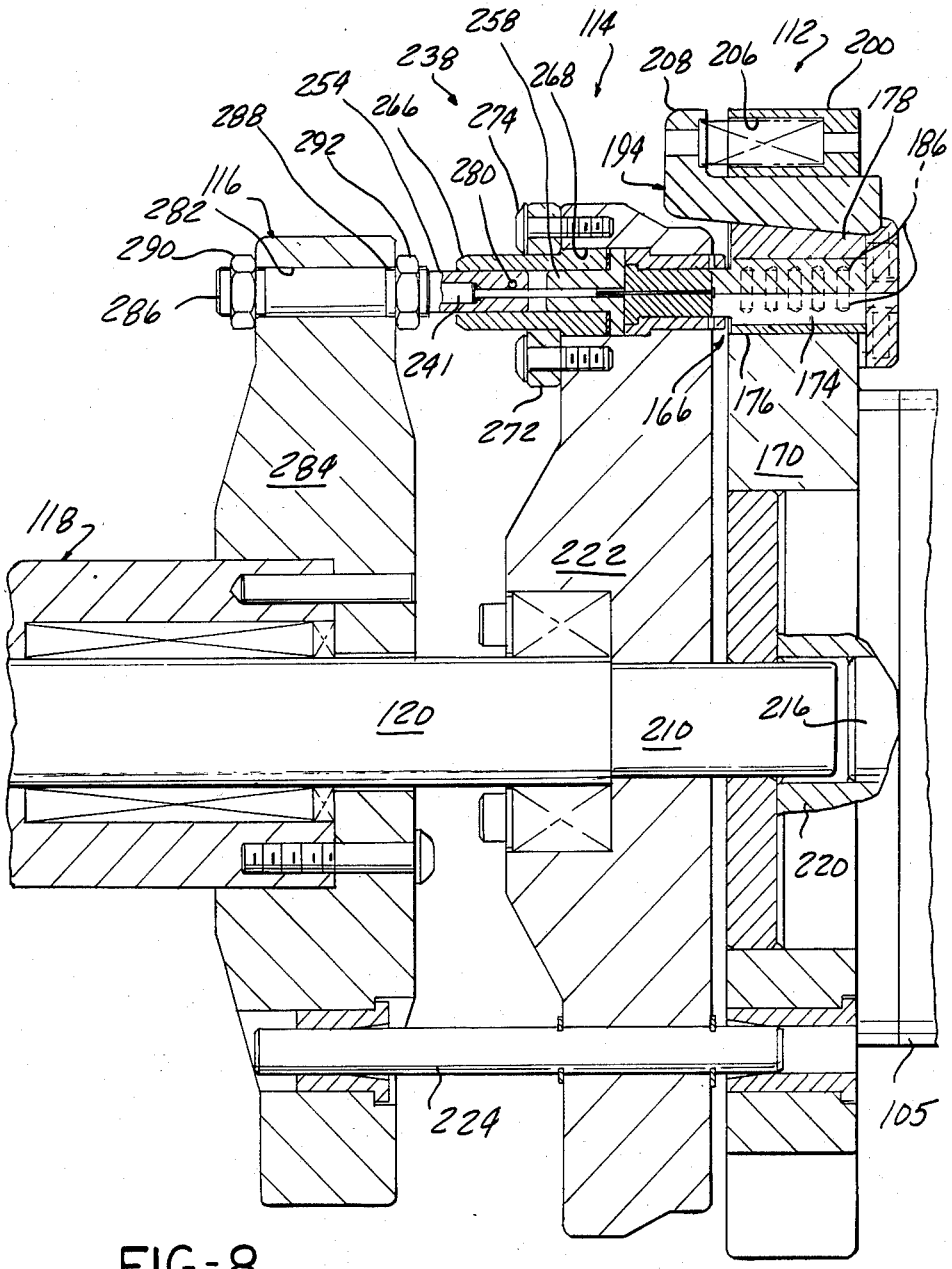
FIG. 8 is a view of the first and second tooling plates and rotary holder plate, each shown in the advanced position.

The tooling engagement is shown in FIG. 8 after the first tooling plate 114 and the second tooling plate 116 are each independently axially advanced, to cause the abutment of each of the coning dies 240 with a respective set of holder halves 174. Subsequent advance of the independently actuated second tooling plate 116 causes advance of the punches 244 by means of engagement of backing pins 241 slidably received within the punch holder 254 to carry out the respective heading forming motions.

Figure 10:
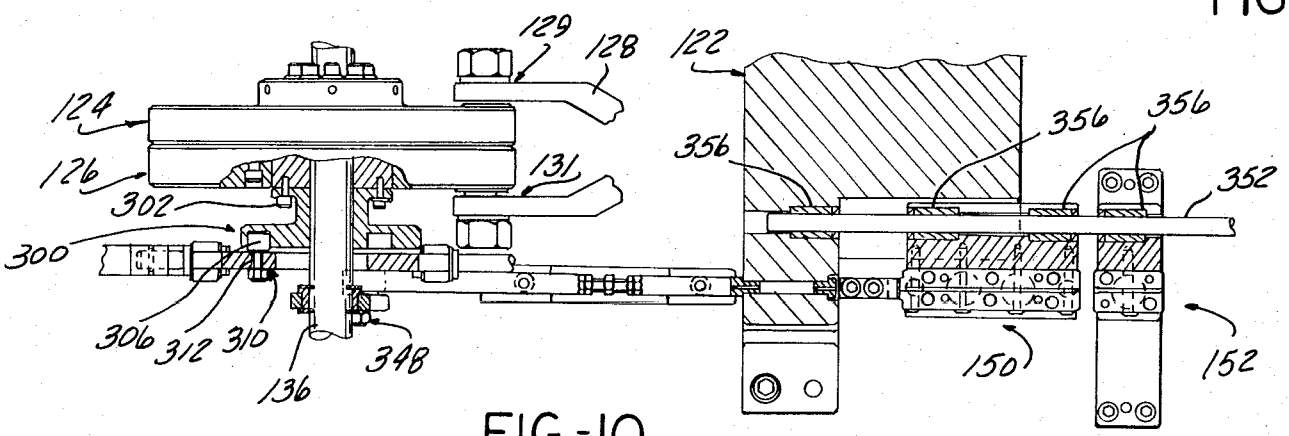
FIG. 10 is a partially sectional plan view of the mechanism shown in FIG. 9.
Figure 9:
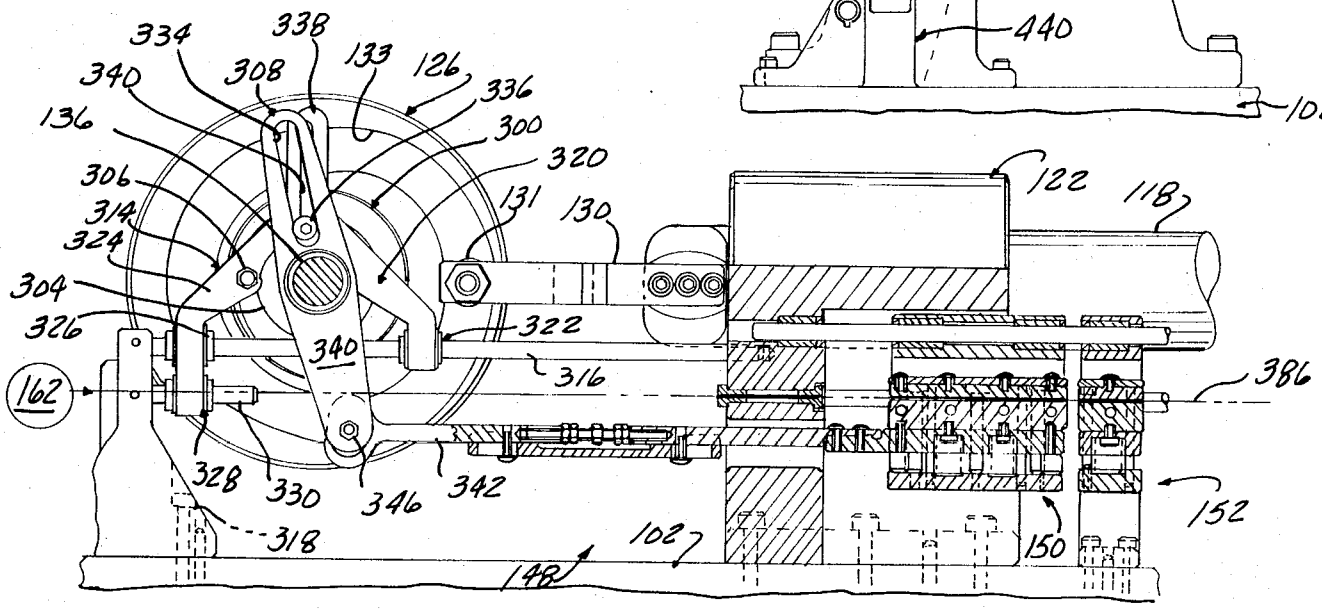
FIG. 9 is a front elevational, partially sectional view of the feed mechanism incorporated in the apparatus shown in FIGS. 4 and 5.
Figure 12:
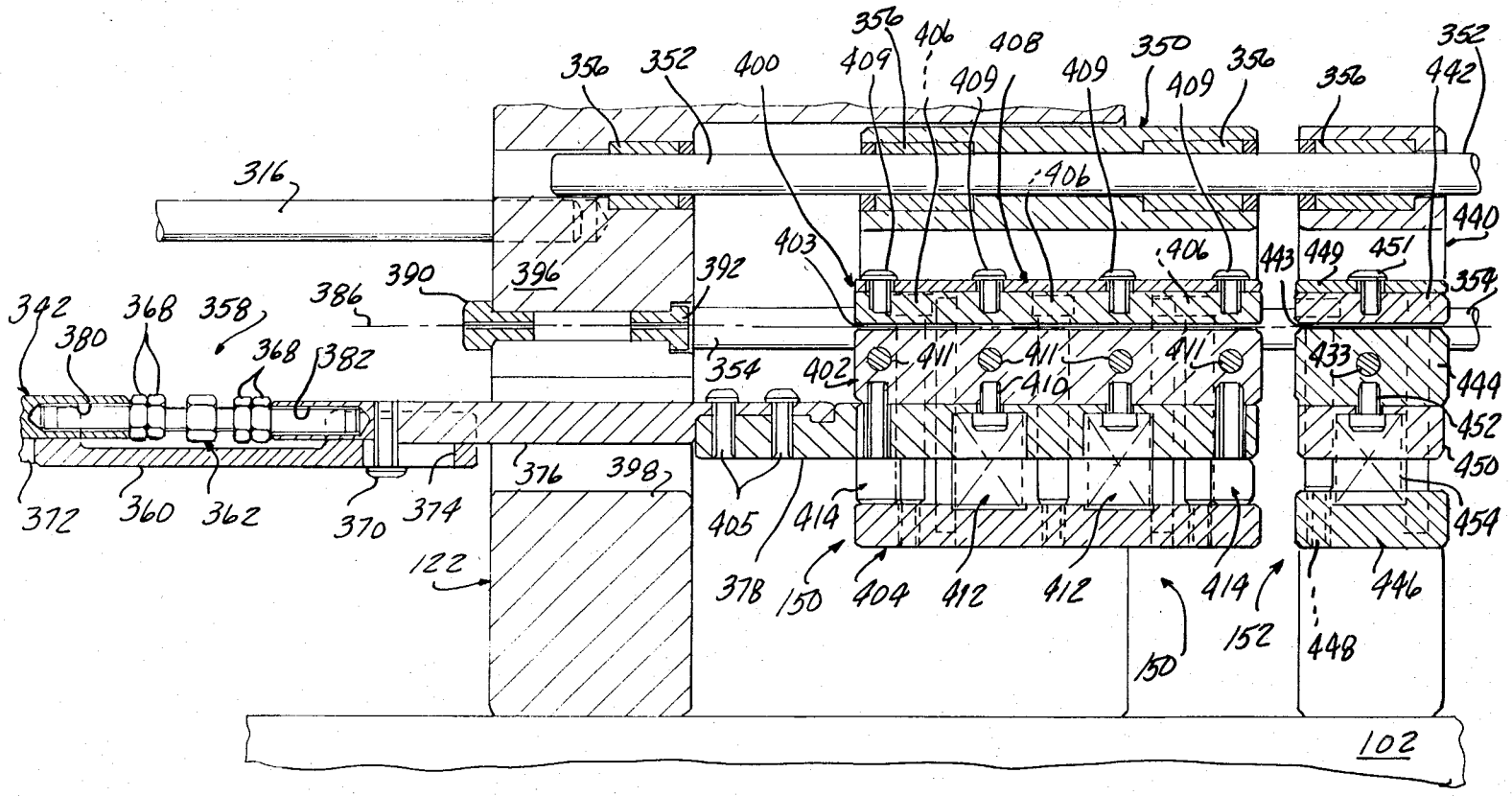
FIG. 12 is an enlarged sectional view of a portion of the feed mechanism shown in FIGS. 9–11.

As previously described, the extension members 118 and 120 are drivingly engaged with rotary cams 124 and 126 to provide independent actuation means, causing the axial advance and retraction of the first and second tooling plate 114 and 116, respectively, which may be carefully adjusted to provide the travel necessary to execute the head forming process described. As seen in FIGS. 9 and 10, extension member 130 has a roller clamp 131 which moves within cam track 133 of cam 126. Extension member 120 similarly carries roller 129.

As described above, the #1 or load work station receives the unshaped blank from the feed and cut-off mechanisms 148 and 160, respectively, which in turn receives wire stock of indeterminate length from a conventional wire straightener 162.

Figure 11:
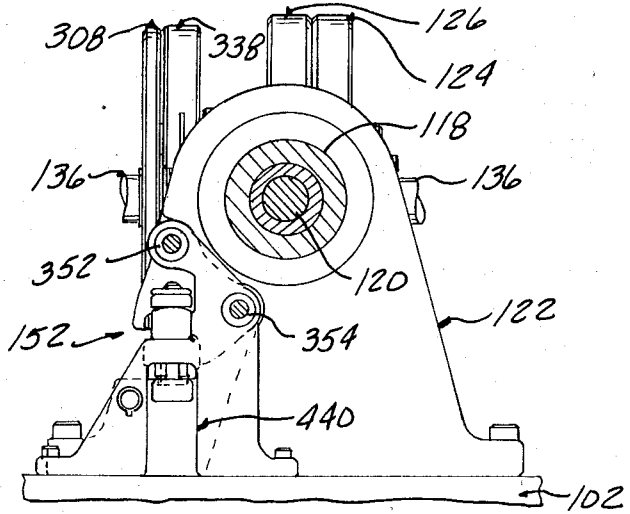
FIG. 11 is an endwise elevational view of the feed mechanism components shown in FIGS. 9 and 10.

FIGS. 9–11 show the details of the feed mechanism 148 which includes a pitman mechanism which includes a drive cam 300 affixed on cross drive shaft 136 which also drives actuating rotary cams 124 and 126. The drive cam 300 includes a cam track 304 within which is received a cam follower 306 such that cam track 304, being eccentrically located with respect to the axis of rotation of cross-drive shaft 136, causes an reciprocating motion of the cam follower 306. The cam follower 306 in turn is secured to a feed arm 320 by means of a nut and lock washer threadably engaging a stem 312 rotatably carrying the cam follower 306.

The stem 312 passes through a feed yoke 314 such that upon rotation of drive shaft 136, an oscillation of the feed yoke 314 occurs due to the cam follower 306 being constrained to move within the eccentric cam track 304. The feed yoke 314 in turn is supported on a guide shaft 316 secured at one end to the main support 122 and to a pedestal support 318 mounted on the base plate 102. Extension arm 320 of the feed yoke 314 is provided with a bushing assembly 322 slidably receiving the main guide shaft 316 and opposite arm 324 of the feed yoke 314 provided with a pair of spaced bushing assemblies 326 and 328 with bushing assembly 326 slidably engaging an offset section of the main guide shaft 316, the bushing assembly 328 receiving a balance shaft 330 also secured to the pedestal support 318.

The constraint afforded by the main guide shaft 316 and balance shaft 330 and the motion induced by the cam follower 306 is thus converted into horizontal reciprocating motion of the feed yoke 314. The motion of the feed yoke 314 is transferred to a feed arm 332 causing oscillation about the axis of cross shaft 136 by an elongated cam track 334 extending radially outward and receiving a cam follower 336 secured to a track arm 338 of the feed yoke 314. The track arm 338 is provided with a radially extending mounting track 340 within which is mounted the cam follower assembly 336. The radial position is adjustable by means of a nut and lock washer retention therein (not shown) such that the feed yoke 314 produces an adjustable throw pitman motion which is impressed on the feed arm 332, resulting in oscillation thereof of a stroke varying with the radial adjusted position of the cam roller 336.

The feed arm 332 also includes a drive arm 340 extending radially opposite the track 334 and which is pinned to a connecting rod 342 by means of a slot 334 having a cam roller 336 secured to the drive arm 340 by means of a nut and lock washer 348.

Thus, the connecting rod 342 is reciprocated through an adjustable length stroke.

The feed mechanism 148 also includes a carriage assembly 350 which is drivingly connected to the connecting rod 342 to likewise be reciprocated on dowel extensions 352 and 354 extending through the main support 122 and passing through the first and second tooling plates 114 and 116 as described above.

A series of bushings 356 provide bearing support for the dowels 352 and 354 and feed carriage 350.

As better seen in FIG. 11, the connecting rod 342 is connected to the feed carriage 350 by means of an adjustment mechanism 358 having an adjusting link 360, an adjustment screw 362 and jam nuts 368, and cap screws 370 passing into a slot 372 formed in one end of the connecting link 360 and slot 372 formed in the other end of connecting link 360. The connecting link 360 joins the connecting rod 342 and a feed link 376 secured to a carriage extension member 378 thus providing an adjustable control over the end positions of the feed carriage 350. The adjustment screw 362 is threadably received within threaded bore 380 in the connecting rod 342 and bore 382 in the feed link 376. The jam nuts 368 secure the adjusted position of the feed screw 362, which is also secured by means of adjustment link 360 and cap screws 370.

Wire stock is received from the wire straightener 162 and passed as indicated along line 386 into a pair of guide bushings 390 and 392 having suitable openings formed therein.

Guide bushings 390 and 392 are received within a bore 394 within a wall 396 of the main support 122, the feed link 376 passing through an opening 398 in the wall 396. The guide bushings 390 and 392 may in some instances be comprised of drawing dies which may perform a slight draw-down on the wire stock 386 in order to ensure a uniform diameter prior to heading and also may afford the advantage of having a slight warming effect on the wire stock prior to its undergoing the heading forming process in the respective work stations. The slight warming effect will make the material slightly more ductile and better able to undergo the material flow necessary to complete the process.

The wire stock 386 then enters into the movable clamping carriage 150, the clamping carriage 150 operated to intermittently be clamped to the wire stock 386 during its advancing feed motion and then unclamped from the wire stock 386 to allow a retraction or return movement of the clamping feed assembly 150, preparatory to another feed cycle.

This clamping function is achieved by the provision of an upper block 400 and a lower block 402 each having longitudinal aligned grooves formed in their opposing faces aligned with the path of the wire stock 386 and together forming a channel 403 which, with the blocks 400 and 402 in a separated condition, allows a sufficient clearance to allow relative movement between the feed carriage assembly 150 wire stock 386. With the upper block and lower block 400 and 402 pressed together, they will securely grip the wire stock 386 for forward transfer. Such relative movement is enabled by separate connection of the upper block 400 to a movable riser block 404 by means of retainer screws 406 having their heads retained beneath a feed cap 408, secured by crews 409, and their lower ends threadably engaged with the movable riser block 404.

The lower block 402 is secured to the feed carriage extension member 378 by means of screws 410, and to the feed carriage 350 by screws 411. The movable riser block 404 is urged away from the feed carriage member 378 by compression springs 412 to thereby urge the upper block 400 into engagement with the lower block 402 to effect clamping of the wire stock 386 thereto. Upon upward motion of the movable riser block 404 a separation of the upper block 400 and the lower block 402 is achieved, limited by adjustment screws 414 threadably engaged to the lower block 402 with the heads disposed in the clearance space between the movable riser 404 and the lower surface of the carriage member 378 such that the opening of the clearance space is limited to that just sufficient to enable free movement of the wire while at the same time preventing escape of the wire from within the opposing grooves in the upper block 400 and the lower block 402.

Figure 13:
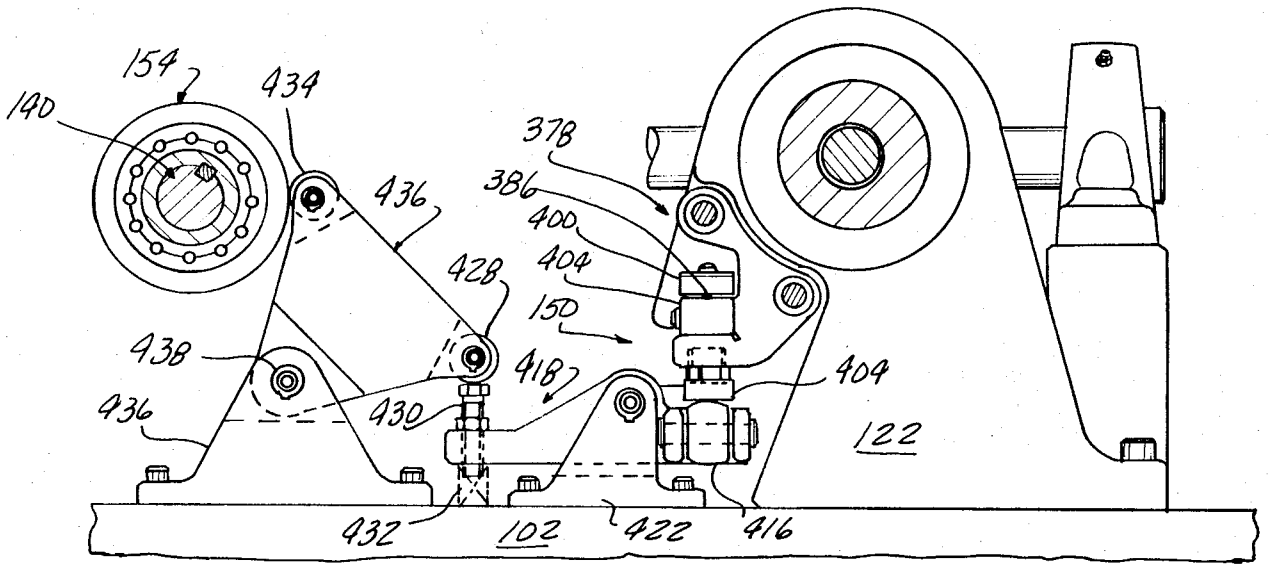
FIG. 13 is an endwise elevational view of the carriage clamp mechanism associated with the feed mechanism shown in FIGS. 9 and 10.
Figure 14:
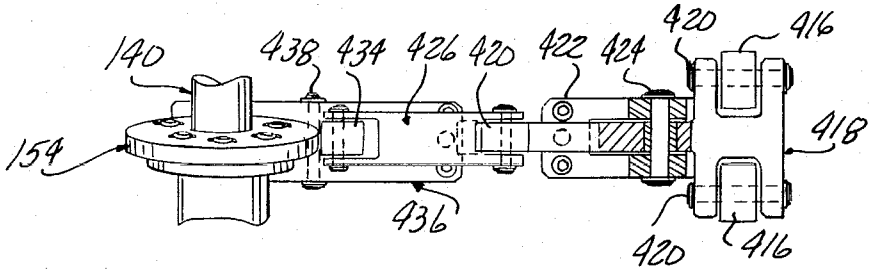
FIG. 14 is a plan view of the carriage clamp components shown in FIG. 13.

As seen in FIGS. 13 and 14, the opposing surfaces of the upper block 400 and the lower block 402 are relieved to ensure clamping pressure being exerted on the wire stock 386 within the groove.

The movable riser 404 thus is reciprocated with the carriage member 378 moving atop cam rollers 416 mounted on opposite clevises of a feed lifter arm 418 by means of axial pins 420 extending therethrough. The feed lifter arm 418 is mounted to a stationary feed lifter base 422 by pin 424 such as to be oscillated thereon in correspondence with oscillating movement of a rocker 426 having a cam roller 428 in engagement with an adjustment screw 430 urged thereagainst by a pressure spring 432. Oscillation of rocker 426 in turn is produced by engagement of a cam roller 434 in engagement with a control cam 436, the control cam 154 driven by drive shaft 140 as described above.

The rocker 426 is rotatably supported on a feed rocker base 436 by means of an axial pin 438. The feed rocker base 426 is mounted to the base plate 102 as shown in FIG. 13.

Accordingly, the moving riser 404 may be urged upwardly under the control of the feed mechanism cam 154 at appropriate points during its reciprocation to and fro atop the cam rollers 416 to cause opening movement of the clamping means associated therewith, that is, separation of the upper block 400 and lower block 402 and clamping and unclamping of wire stock 386.

Figure 15:
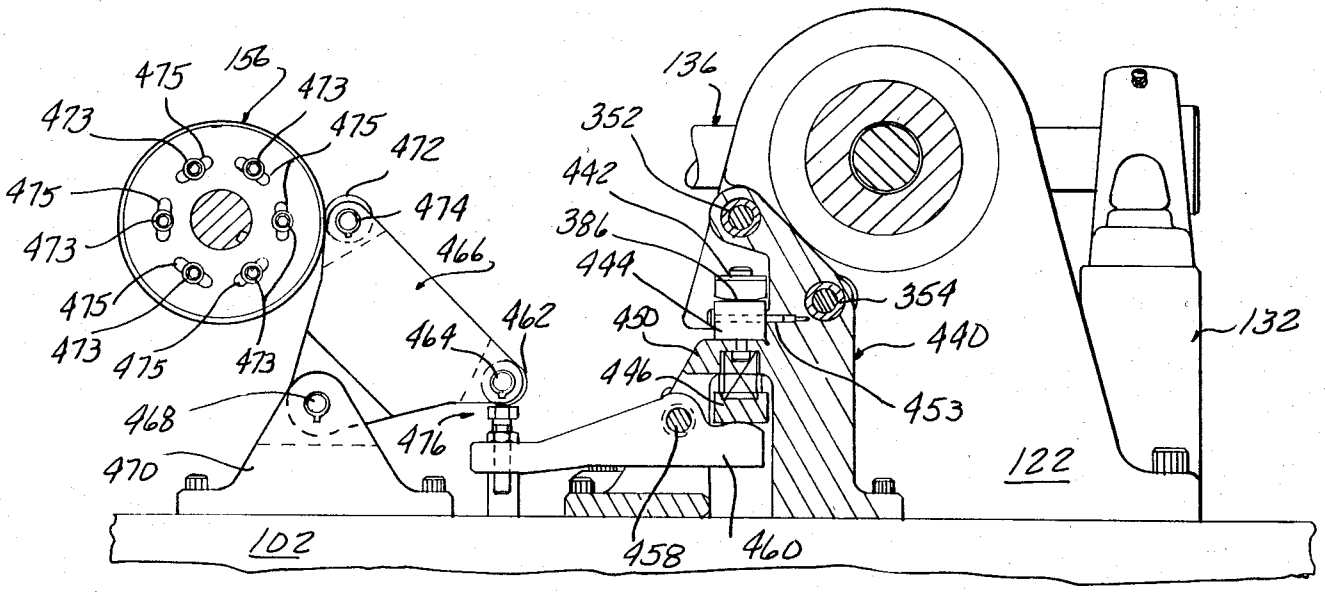
FIG. 15 is an endwise partially sectional view of the stationary clamp incorporated in a cut off mechanism included in the apparatus shown in FIGS. 4 and 5.
Figure 16:
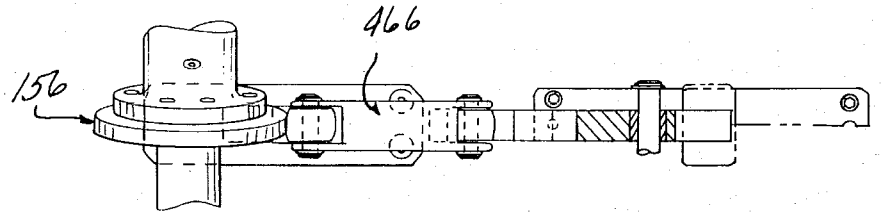
FIG. 16 is a plan view of the stationary clamp components shown in FIG. 15.

As shown in FIGS. 11, 15, and 16, the apparatus includes a stationary clamping mechanism 152 which is not reciprocated by the feed mechanism but rather acts to secure the wire stock 386 preparatory to a cutoff cycle by the cutoff mechanism 160. In this instance, the stationary clamping mechanism 152 includes a stationary clamping base 440 secured to the base plate 102, the clamping base 440 receives the dowel 352 and is provided with dowel bushings 356 as is dowel 354, thence passing through to the first and second tooling plates 114 and 116 (not shown). In similar fashion to the feed carriage 150, an upper clamping block 442 and lower clamping block 444 are provided having an opposed groove at the interface thereof to provide a channel 443 for the wire stock 386 to pass therebetween. In a clearance condition, achieved with separation of the upper clamping block 442 from the lower clamping block 444, there is provided a release of the wire stock 386 from clamping engagement.

The upper clamping block 442 is secured to a stationary riser 446 by means of cap screws 448 passing through the upper clamping block 442 and the lower clamping block 444 and a web section 450 of the stationary clamping base 440 thence threadably received within the stationary riser plate 446. The lower clamping block 444 is affixed to the web section by means of a screw 452 and cross screw 433. A compression spring 454 urges the stationary risers 446 downwardly to induce separation of the upper clamping block 442 from the lower clamping block 444 by virtue of the connection afforded by retainer screws 448. The stationary adjustment screw 456 is provided in the clearance space between the stationary riser 446 and the stationary web section 450 to limit the upward movement of the stationary riser 446 and the extent of separation between the upper clamping block 442 and the lower clamping block 444.

A top plate 449 is retained by screw 451 to limit the upward movement of the retainer screws 448, engaging the heads of the retainer cap screws 448 to thus cause the upper clamping block 442 to move upwardly together with the stationary clamping riser 446.

The clamping riser 446 is caused to be moved upwardly and downwardly vertically by means of a cam operated lifter arm 456 which is pivotally mounted at 458 to the clamp base 440 with a forward section 460 having its upper surface in engagement with the under surface of the riser 446. The cam follower 462 is pinned at 464 to one corner of a rocker plate 466, in turn pinned at 468 to a stationary base 470 affixed to base plate 102.

The third corner of rocker 466 carries a cam follower 472 rotatably supported at 474 in engagement with the stationary clamping cam 156.

The cam 156 timing is adjustable by the screws 473 and slots 475 securing the shaft 140 to cam 156.

The cam follower 466 is in engagement with an adjusting screw 476 carried in the outer arm of the lifter 456 such that corresponding up and down movement of the lifter portion 460 causes motion of the stationary riser 446 and the clamping block 444.

Figure 19:
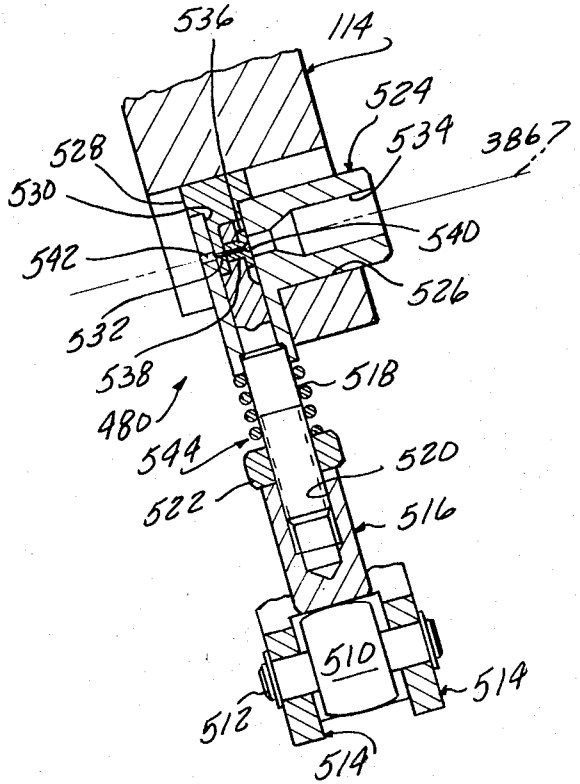
FIG. 19 is an enlarged sectional view of the cut off die set and other components of the cut off mechanism shown in FIG. 17 taken along the lines of 19—19 in FIG. 17.
Figure 18:
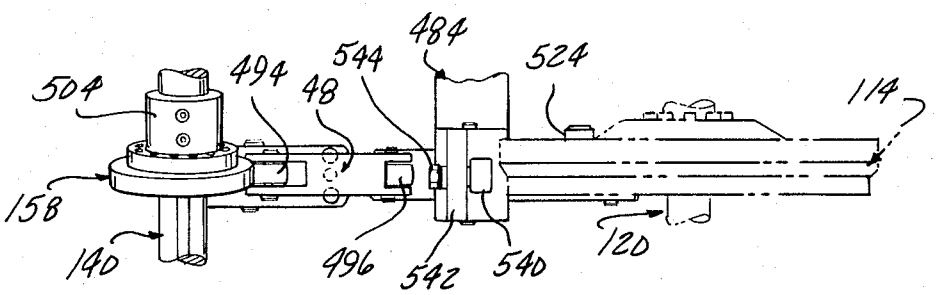
FIG. 18 is a plan view of the cut off operator components shown in FIG. 17.
Figure 17:
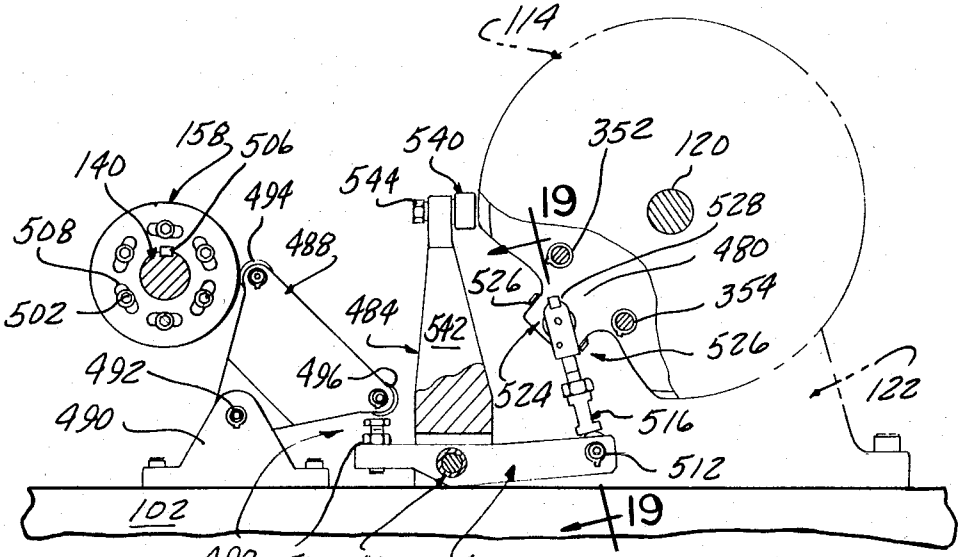
FIG. 17 is an elevational view of the operator components for the cutoff mechanism incorporated in the apparatus shown in FIGS. 4 and 5.

Referring to FIGS. 17–19, the first tooling plate 114 includes a cut off die set 480 aligned with the #1 or load station receiving the wire stock 386 from the feed mechanism 148 via the stationary clamping mechanism 152. The cut off die set 480 is operated by a cut off lifter arm 482 pivotally mounted to a stationary support base 484 mounted to the base plate 102. Cut off mechanism rocker 488 is pivotally mounted to a rocker base 490, also secured to the base plate 102 as shown, by means of a pivot connection 492. The cut off mechanism cam 158 engages the cam follower 494 located in one corner of the cutoff rocker 488. A second cam follower 496 in a second corner of the cutoff rocker 488 rises atop the head of an adjustment bolt 498 received within one end of the cutoff lifter arm 482 with a jam nut 500 provided to secure the adjusted position.

The cam 158 is adjustably mounted by means of cap screws 502 threadably received within a hub 504 affixed to the drive shaft 140 by key 506. Cap screws 502 pass through elongated slots 508 to allow for angular adjustment thereof for proper setting of timing of the cam motion. The cutoff lifter arm 482 is mounted to a cam follower 510 at its outer end carried by punch pin 512 in a clevis portion 514 of the right hand end of the cut off lifter arm 482 as viewed in FIG. 17.

Adjustment stop member 516 is located at the lower end of the cut off die set 480, which rides the cam follower 510 threadably receiving a moving die holder 518 in a threaded bore 520.

A nut 522 maintains such adjusted position.

The cut off locator member 524 is secured within a bore 526 of the first tooling plate 114 by a pair of cap screws 528 (FIG. 17).

The cut off locator 524 also receives a stationary cut off die 528 within a bore 530, the stationary die cutoff die 528 being positioned pressed within the bore 526 such as to be relatively fixed. The fixed cut off die 528 includes a through passage 532 sized to just receive the wire stock 386. The cut off locator 524 includes a guide opening 534 which directs and guides the wire stock 386 to a stationary cutoff die 536 carried within the outer end of the die holder 518. The stationary cutoff die 536 also includes a through passage 538 chamfered at 540 to also guide the wire stock 386 thereinto.

Finally, a through passage 542 is formed in the side wall of bore 530 of the die locator 524 to thus allow through passage of the wire stock 386. The moving die locator 518 is shown in the up or stroked position via spring 544 which urges the moving die holder 518 and the adjustment stop member 516 against the cam follower 510.

In the stroked position, there is produced a slight misalignment of the opening 538 of the moving cutoff die 536 to induce a shearing action to produce a cutoff of the wire stock material 386 and thus form a blank of predetermined length at the interface between a moving cutoff die 536 and the inside face of the stationary cutoff die 528 having the opening 532 normally aligned therewith.

Such cutoff operation is timed in relation with the locking of the stationary clamp 52 and the operation of the clamping means at the #1 station on the holder plate 112 so that the adjacent sections of wire stock is secured prior to cutoff.

Each of the holder means 166 is operated at the #1 work station such as to be unlocked to receive the end of the wire stock and thereafter clamping means associated therewith is operated to secure the blank within the holder means opening. This is at the same time that the stationary clamp 152 is operated, and just prior to the operation of the cutoff mechanism 160 in order to securely hold the length of wire stock during the cutoff operation.

Each of the holder means 166 is then indexed through each of the work stations #2–#8 in a locked or clamped condition, with the ejection of the formed articles taking place at the #8 work station. Release of the holder 166 at this station is achieved by a stationary cam roller 540 (FIGS. 17 and 18) which is located at an axial location such as to contact the base of the tapered locking members 194 associated with each of the holders 166 as rotation of the rotary holder plate 112 proceeds therepast. Support for the fixed cam roller 540 is provided by the support base 484 on the upper section 542 thereof with a nut 544 threadable received on a support axle mounting the cam roller 540.

As noted, positive clamping and unclamping means are provided associated with each of the holders 166 as it moves into position in work station #1 for the purpose of assuring that the clamping means at that station is initially opened to receive the wire stock as it is advanced thereinto by the feed mechanism 148. Subsequently each of the clamping means associated with each of the holders 166 is moved to the clamped or locked position prior to execution of the cutoff step.

This also moves the holder 166 to the clamped position prior to its being indexed into the respective work stations #2–#6 whereat the tooling comes into engagement with the unformed or partially formed blank during the head forming operations.

Figure 20:
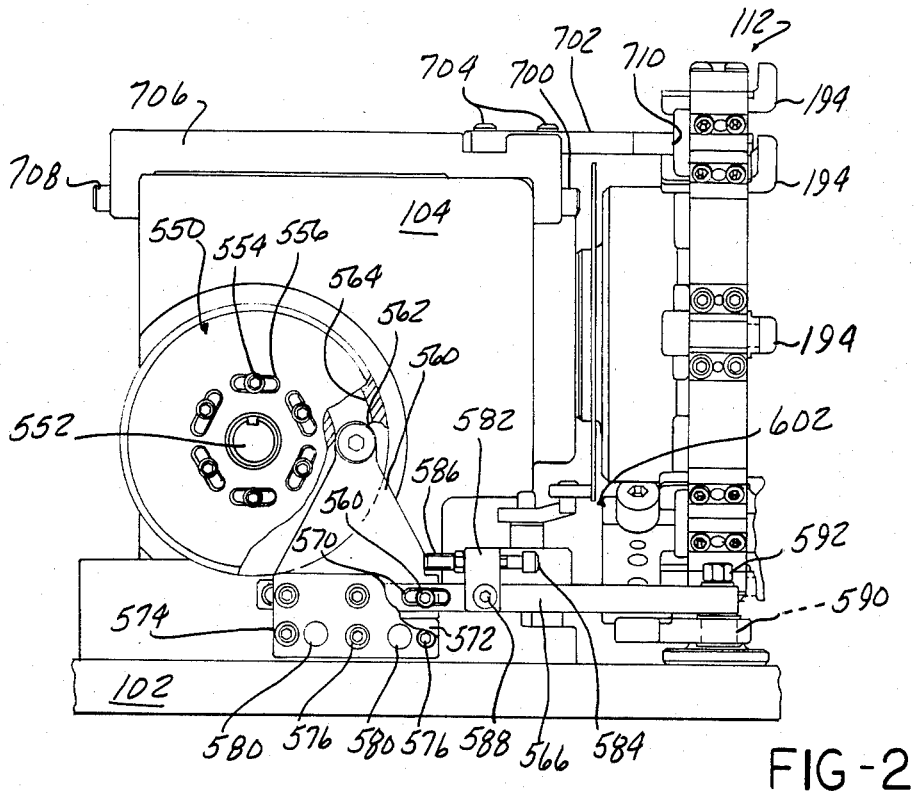
FIG. 20 is an enlarged fragmentary view of the apparatus as shown in FIGS. 4 and 5 depicting the associated holder clamp operating components.
Figure 21:
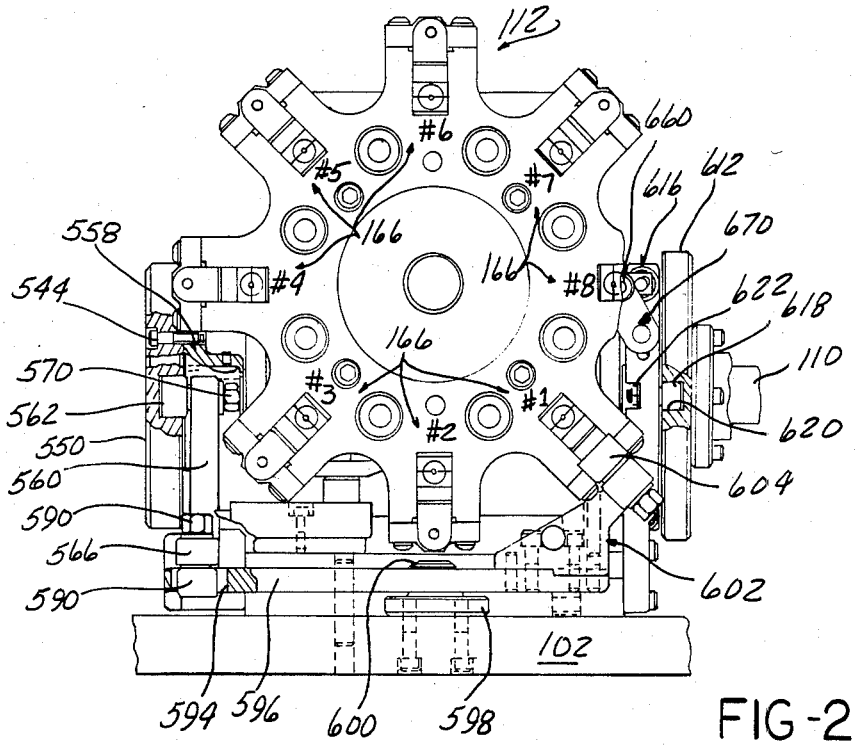
FIG. 21 is an endwise elevational view of the rotary holder plate assembly shown in FIG. 20 with components of the holder clamp operating means shown as well as the ejection mechanism components in partial section.
Figure 22:
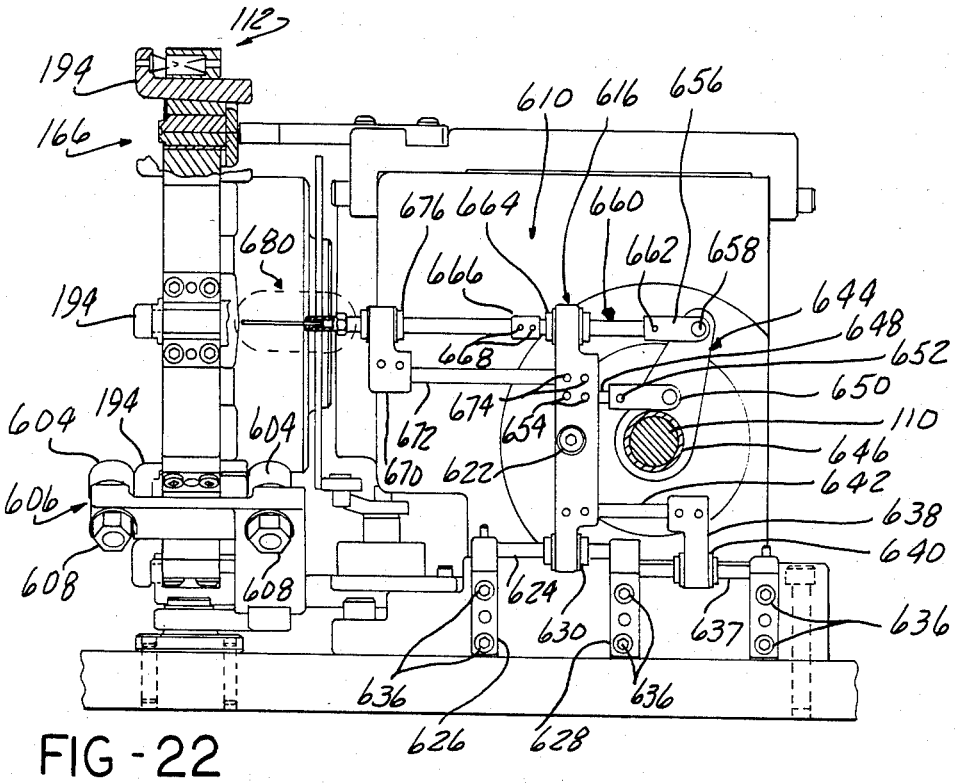
FIG. 22 shows a side elevational view in partial section showing components of the holder clamp operator shown in FIGS. 20 and 21 and components of the ejection mechanism associated therewith.

As depicted in FIGS. 20, 21, and 22, an arrangement is disclosed for operating the clamping means associated with each of the holders 166 after it rotates into the #1 setting. This includes a clamp operator cam 550 run by a shaft extension 552 driven by the right angle drive 104. Cap screws 554 pass through slots 556 and are received within the housing section 558 affixed to the extension 552 to enable adjustment of the timing thereof.

Follower plate 560 is provided, mounting a cam follower 562 received within a cam track 564 formed in the clamping operator cam 550. Follower plate 560 is fixed to a follower arm 566 by means of cap screws 568 passing through elongated slots 570 in order to provide an adjustment thereof. The follower arm 566 and follower plate 560 are slidably positioned within a base 572 and a slide plate 574 affixed together by means of cap screws 576 and dowels 580.

An adjustable stop is provided by a stop plate 582 receiving a cap screw 584 having its end in abutment with an end face 586. The stop plate 582 is affixed to the follower arm 566 by means of a cap screw 588 to thus provide a securement of the adjusted position of the follower plate 560 with respect to the follower arm 566 to securely locate the end position of the follower arm 566.

Fixed to the far end of the follower arm 566 and to the right as viewed in FIG. 21 is a cam follower 590 secured by means of a nut 592. The cam follower 590 moves within a slot 594 in a clamping operator arm 596 extending transversely across the width of the rotary holder plate 112 and at right angles to the follower arm 566. A clamping operator arm 596 in turn is supported on a support plate 598 and a pivot 600 to provide a pivotal support thereof on the base plate 102. The far end of the operating arm 596 has affixed thereto a yoke assembly 602 which supports and positions a pair of cam rollers 604 on a cross arm portion 606 thereof by means of nuts 608. The cam followers 604 are positioned at the #1 work station such as to just straddle the lock member 194 as each of these rotates through the #1 tool station. Thus reciprocating movement of the follower arm 566 induced by rotation of clamping means and operator cam 550 produces pivoting movement of the clamping operator arm 596 and side-by-side motion of the yoke assembly 602 to enable locking and unlocking motion of the tapered locking member 194 of the particular holder means 166 located in the #1 work station. This locking and unlocking is coordinated by the timing of the clamping operator cam 550 to provide the initial unlocked condition of the associated holder means 166 after indexing into the #1 tooling station to enable insertion of the wire stock material and thereafter the locking thereof preparatory to the cutoff cycle.

Subsequently, the indexing rotation of the rotary holder plate 112 rotates the associated holder 166 through the respective stations whereat forming is carried out with the tapered locking member 194 remaining in the locked position.

In order to insure that the tapered locking member 194 is in the full locked position, a fixed stop may be provided (not shown) in order to insure full movement thereof and full operation of the clamping means associated with each of the holders 166 prior to the initiation of the forming process.

The ejection mechanism 610 is best seen in FIG. 22 and is also cam operated. Ejection cam 612 is rotated by cross shaft 110 by means of a connection to a hub 614. An ejection bar 616 is provided having a cam follower 618 disposed within a cam track 620 formed in the ejection cam 612. Cam follower 618 is retained by a nut 622. The ejection bar 616 is constrained for horizontal reciprocating motion induced by rotation of the ejection cam 612 by being mounted on guide rod 624 between rails 626 and 628 and ball bushing 630 on guide rods 632 mounted on rail 628 and rail 634 secured by cap screws 636. An offset 638 is provided with bushings 640 and extension rods 642 to secure the same to the ejection bar 616.

Movement is also constrained by mounting to an ejection arm 644 rotatably mounted on shaft 110 by a bushing 646. A rod 648 and end clevis 650 establish connection to the ejection bar 616. The clevis 650 is pinned to rod 648 at 652 to thereby drive rod 648 secured to the ejection bar 616 by pins 654. The ejection bar 644 is also pinned to clevis 656 at 658. The clevis 656 is connected to one end of ejection rod 660 at 662. The ejection rods 660 and ejection bar 616 extend through slide bushing 664, and in turn abuts a block 666 fixed by pins 668 thereto.

Accordingly, rotation of the ejection cam 612 causes reciprocation horizontally of the ejection bar 616 to in turn induce rotation of ejection arm 644 via the clevis 650 and rod 648 connection. Rotation of the ejection arm 644 in turn produces reciprocation or stroking of the ejection rod 660 via the clevis 656 and rod 660 connection therebetween.

Ejection rod 660 mounts an ejection pin assembly 680 at its forward end which is aligned with the #8 station such as to cause ejection of the formed brush contact holder therefrom for collection in a tubular conduit (not shown) or by any other suitable means.

Figure 23:
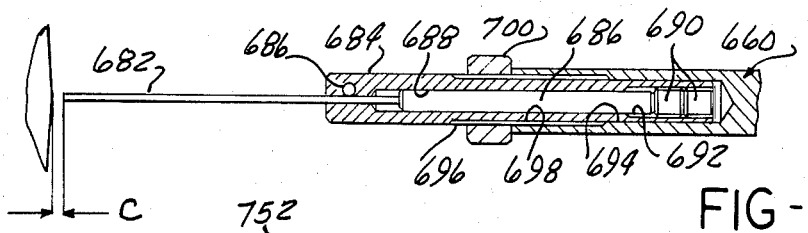
FIG. 23 is an enlarged sectional view of certain components of the ejection mechanism shown in FIG. 21.

FIG. 23 shows the ejection pin 682 in position with a clearance space "C" in the retracted position of the ejection rod 660.

Punch 662 is held in a punch holder 684 with a cross pin 686 to locate and retain the same therein. A backing pin 686 is also provided in abutment with the rear face of the ejection pin 682. The backing pin received within a bore 688 formed in the pin holder 684. Set screws 690 are provided and received in a threaded bore 694 in the rear of the ejection pin holder 684 serving to locate and retain the backing pin 686 against the rear face of ejection pin 682.

Ejection holder 684 in turn is threadably received within a bore 694 at the forward end of the ejection rod 660. A threaded section 696 intermediate the length of the punch holder 694 threadably engages a threaded section 698 on the interior bore 694 with a jam nut 700 also threadably engaging a threaded section 696 and seated against the forward face of the ejection rod 660 thereby enabling adjustment in the axial position of the ejection pin 682 with respect to the ejection rod 660 for setting the clearance space "C".

Accordingly, during each machine cycle, the ejection cam 612 rotation causes stroking of the ejection pin 682 into the holder 166 which has previously been unlocked by engagement by the fixed locking cam roller 540 to produce the ejection of the formed article.

A backing plate 702 is also provided fixed by means of cap screws 704 to a mounting plate 706. The mounting plate in turn is mounted by cap screws 708 to the indexing drive 104 as shown in FIG. 20.

Backing plate 702 includes a forward face located adjacent to a backing plate 190 mounting each of the holder means 166 such as to provide a backup to the forces exerted during the heading stroking of the first and second tooling plates 114 and 116.

Figure 24:
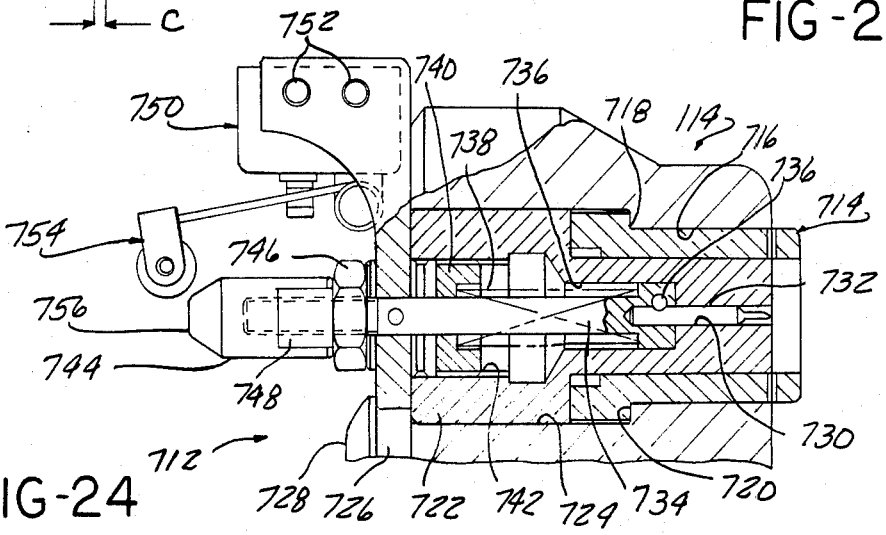
FIG. 24 is an enlarged partially sectional view of a broken punch detector incorporated in a work station of the apparatus shown in FIGS. 1 and 5.

Referring to FIG. 24, a broken punch detector assembly 712 is shown, which is mounted at the #7 work station, in order to detect a broken punch, which would remain within a formed part after indexing into the #7 tooling station.

Detector assembly 712 is mounted to the first tooling plate member 222 at the location of the #7 work station and includes a guide tool 714 received within bore 716 having a projecting portion, as shown in FIG. 24, adapted to pilot on the projecting portion 184 of the holder means 166 indexed to the #7 station.

A forward shoulder 718 is seated against the corresponding 720 shoulder. A guide sleeve 722 is also mounted within a bore 724 in abutment against the guide 714. Both are retained therein by a mounting plate 726, secured by means of cap screws 728 to the opposite endface of the second tooling plate member 222 as shown. the probe guide sleeve 722 includes a forward bore 730 receiving probe 732 aligned with the holding means opening 180. Probe 732 is secured to a probe holder 734 by means of a dowel 736 with holder 734 slidably retained in bore 736 formed within the probe guide 732 to the rear of the opening 730.

A bias spring 738 urges the probe 732 and holder 734 to the right to the position shown in FIG. 24. The compression spring 738 is seated against a tension adjustment nut 740 received in threaded bore 742 formed in the probe guide 722.

The probe holder 734 has mounted thereto an actuator pin 744 located at the opposite end of the probe holder 734 so as to be moved together therewith, which is urged against a stop nut 746 threadably engaging the actuator pin 744, which is provided with a pair of wrenching flats 748 to enable tightening against the stop nut 646.

A limit switch 750 is mounted to the retainer plate 726 by screws 752 and includes a sensor arm 754 located opposite sloping surfaces 756 formed on the detector pin 744. Thus as the first tooling plate 114 advances during each cycle, if a punch has broken and remains within the formed article, the probe 732 will come into contact therewith, driving the entire assembly backwards causing tripping of the actuator arm 754 and generation of an electrical signal by the limit switch 750 to enable shut-down of the machine and triggering of the appropriate alarm or indicator signals.

Figure 25:
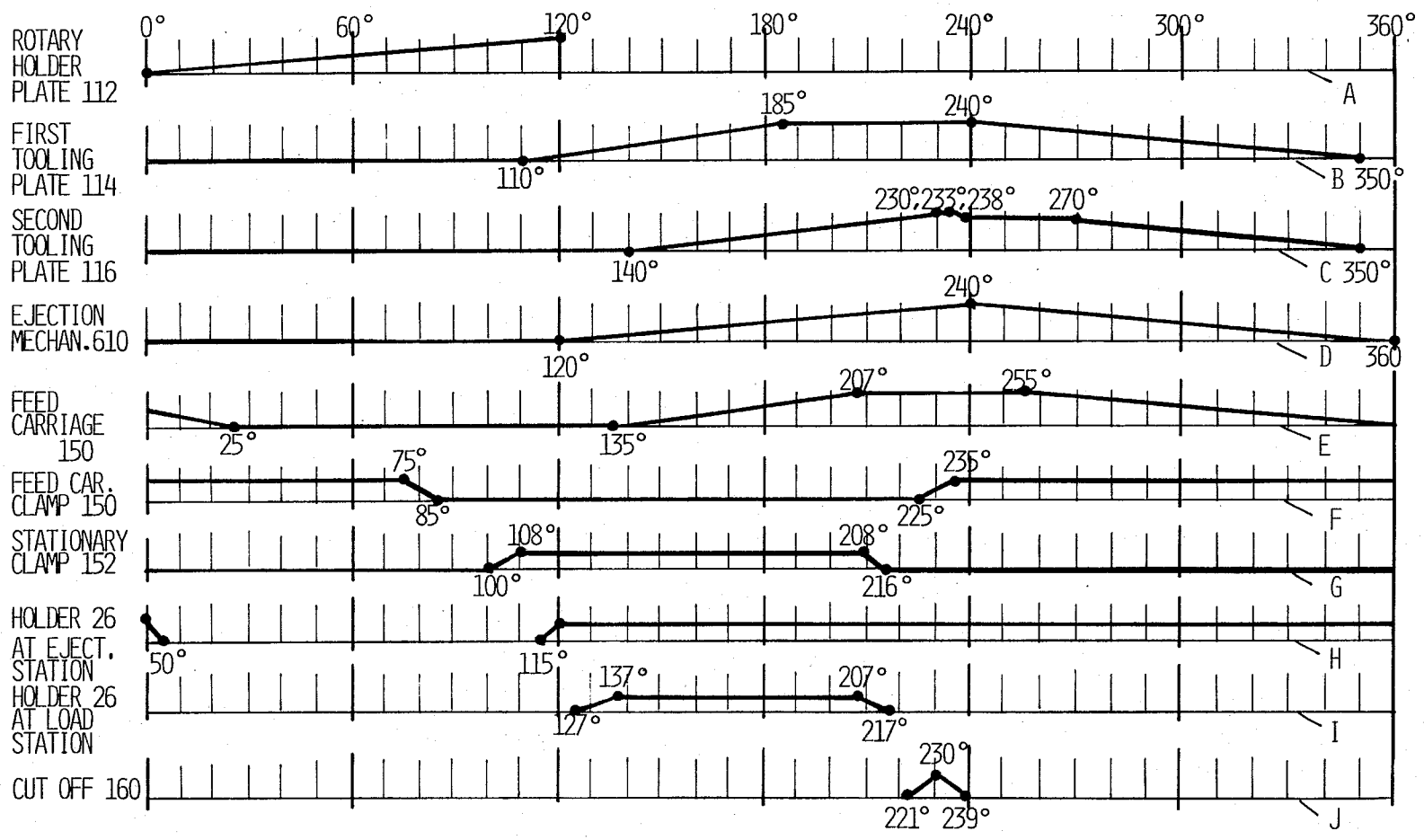
FIG. 25 is a diagrammatic representation of the relative timing of the coning die and punch actuation in the apparatus shown in FIGS. 4 and 5.

Referring to FIG. 25, all the various components motions are depicted in diagrammatic form. The indexing of the rotary holder plate 112 occurs during the first 120° point of the machine cycle with the machine cycle being taken as 360°. Thereafter, the rotary holder plate 112 remains stationary during the subsequent tooling operations as shown in coordinate line A.

As shown in coordinate B, the first tooling plate 114 remains stationary during the indexing motion but begins its advance approximately at the 110° point, i.e., 10° prior to the cessation of indexing movement of the rotary holder plate 112.

Advancing motion of the first tooling plate 114 carrying the cone dies 238 is completed at the 185° point and is maintained in position with the dies in the closed position until the 240° point in the machine cycle.

Thereafter, the first tooling plate 114 retracts to return to the beginning or retracted position at the 350° point.

As shown on coordinate line C, the second tooling plate 116 carrying the punches 244, does not begin its advancement until the 140° point lagging the motion of the first tooling plate 114, but is thereafter advanced to execute the forming operations to the 230° point, with a 3° dwell to the 233° point and thereafter the slight withdrawal over the next 5° to the 238° point, i.e., 0.003 inches withdrawal. After a dwell to the 270° point the second tooling plate 116 carrying the punches 244 is withdrawn to the return position at the 350° point of the cycle.

Thus, the substantial withdrawal of the first tooling plate 114 is well underway prior to any significant retracting motion of the second tooling plate 116 for the purposes described above.

The ejection mechanism 610 is depicted along coordinate D, in which the ejection begins as soon as the indexing motion of the rotary holder plate 112 has ceased, i.e., at the 120° point and is completed at the maximum advance of the ejection pin occurring by the 240° point and the withdrawal being completed at the 360° point.

The feed carriage 150 motion is depicted along coordinate E in which the advancing motion thereof begins at approximately the 135° point in the cycle completing insertion of the wire stock by the 207° point, with a dwell to the 250° point and thence returned to the return position at the 25° point as seen at the left-hand side of the coordinate E.

This is combined with the clamping motion of the feed carriage 150 shown along axis F in which the carriage is open until the 75° point clamping motion completed by the 85° point and remains closed until the 225° point. This insures that the forward motion of the feed carriage 150 carries the length of wire stock together with the opening. Release of the clamp occurs at the 225° point and is completed by the 235° point to insure that during the dwell period of the feed carriage 150 motion the wire stock is released such that during return motion of the feed carriage 150, initiated at the 255° point in the cycle, the wire is released to enable retraction of the carriage 150 and clamping to a fresh section of wire stock.

The stationary clamp 152 opening and closing as shown along coordinate G which the opening movement occurs at the 100° point of the cycle and is completed rapidly at the 108° point to insure free motion of the wire stock therethrough as the feed carriage 150 advances at the 135° point with the wire stock clamped thereto.

The locking, unlocking motion of the holder 166 at the ejection station is shown along coordinate H, which includes an opening or unlocking motion of the holder 166 at the ejection station at the 0°–5° point with the holder being closed substantially entirely during the rotary holder plate 112 indexing rotation. Thereafter, the holder 166 is opened at the 115° point, and remains open to ensure free ejection by the ejection mechanism 610 which occurs from 120° to the 360° segment of the machine cycle.

The unlock motion of the holder 166 at the load station is depicted along coordinate I, with an opening motion initiated at the 127° point, completed at the 137° point. The holder 166 at the load station remains open until the 207° to 217° segment of the machine cycle. The holder 166 at the load station is again locked preparatory to the cutoff cycle.

The timing of the cutoff mechanism 160 is shown along coordinate J, which is initiated at the 221° point and is completed at the 230° point and retracted by the 239° point in the machine cycle. Thus cutoff occurs only after the holder 166 in the load station has been locked as well as the stationary clamp 152 which has completed its locking motion by the 216° point shown along coordinate G.

It can be appreciated that the timing of the relative motions is adjustable by the arrangement shown above, such that the necessary timed relationship of the various motions can be achieved at assembly.

Figure 26:
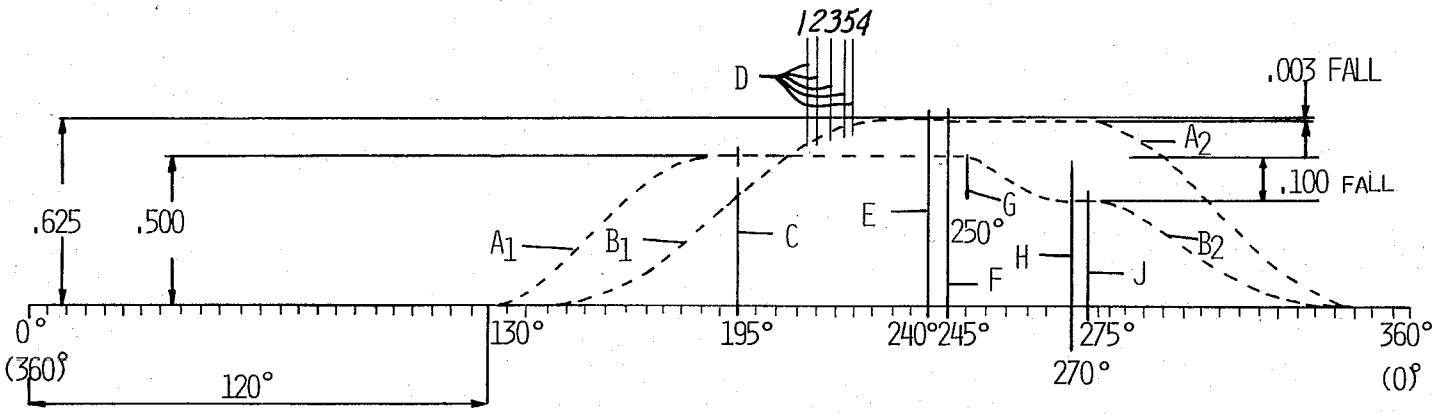
FIG. 26 is a diagram showing the relative timing of the motion of each of the components of the apparatus shown in FIGS. 4 and 5.

FIG. 26 diagrammatically represents the timing of the actuation cams 124 and 126 for the first and second tooling plates 114 and 116 respectively. This timing illustrates the relative timing of the punches and coning dies. During the first phase of the cam rotation, the first 120° as shown, the indexing motion of the rotary holder plate 112 occurs, moving the respective holders advancing the respective holders 26 to the next station such that no axial motion of either the first or second tooling plates 114 and 116 respectively occurs.

Immediately thereafter, the first tooling plate 114 is caused to be advanced slightly as represented by curve $A_1$ with a slight lag as indicated by curve $B_1$ in the advancing motion of the second tooling plate 116. The advance of the second tooling plate 116 is completed at the 195° point, which is prior to contact of the respective punches with the blanks, which occur at the point indicated by line C. As can be seen, the respective contact points are slightly staggered, represented by line D such that the load imposed by the forming of the blanks is somewhat staggered to reduce the peak load on the drive cam 126, the forming being completed at the 240° point as indicated by line E. As indicated at line F, the punches are withdrawn slightly (0.003″), at the 245° point to relieve the forming pressure on the punches 244.

Immediately thereafter, at the 250° point, as indicated at line G, the withdrawal of the coning dies 238 is achieved by withdrawal of the second tooling plate 116 with an initial 0.100 inches fall at the 275° point indicated at line H. A pause in the cone withdrawal motion occurs with both tooling plates 114 and 116 continuing their withdrawal as indicated at line J with the coning dies 238 preceding the withdrawal of the punches 244 as indicated by curve segments A2, B2 until the 360° cycle is complete.

It is also noted that the progressive forming of the lengths enables a relatively gradual flow of material which is an aid in maintaining the proper ductility of the completed contact 10 and also contributes to the relatively great ratio of the length to diameter ratio achieved with the present apparatus.

Suitable material which have been employed consist of copper alloys, each of which are below listed, beginning with the best material and ending with the least desirable material, using the Copper Development Association standard numbers.

The more malleable material listed earliest are most desirable for increasing the useful life of the punches and dies:

| | |
|---|---|
| 1. CDA162 | 4. CDA510 |
| 2. CDA165 | 5. CDA260 |
| 3. CDA651 | 6. CDA270 |

Many variations of the present process and apparatus are of course possible by substitution of equivalent arrangements for achieving the various functions.

The specifics of the particular embodiment described will of course vary with the article to be formed and the configuration of the article to be produced thereby and it will be appreciated by those skilled in the art that the concepts of the apparatus and process described here may have a wide range of application.

We claim:

1. Apparatus for forming articles from elongated blanks by heading comprising:

an axially fixed holder plate;

at least one holder carried by said holder plate having an opening adapted to receive one end of an elongated blank, said holder also including means for clamping a received blank end disposed therein;

a first tooling plate carrying a die having an opening locatable opposite said holder carried by said holder plate;

means for mounting said first tooling plate to be axially movable toward and away from said holder plate;

means for causing controlled timed advance and retraction of said first tooling plate consisting of movement of said first tooling plate towards and away from said holder plate bringing said die opening from a position remote from said holder opening to a position overlying said holder opening to create a closed end die opening with said blank protruding thereinto;

a second tooling plate juxtaposed to said first tooling plate on a side thereof remote from said holder plate carrying at least one punch axially aligned and extending towards said at least one die opening in said first tooling plate;

means for mounting said second tooling plate for independent axial movement towards and away from said first tooling plate;

means for causing controlled timed advance and retraction of said second tooling plate comprising movement of said second tooling plate toward and away from said first tooling plate respectively to cause advance of said at least one punch into said at least one die opening to enable heading of a blank retained in said at least one holder in said at least one die opening;

means for successively feeding blanks into said at least one holder;

means for ejecting formed articles from said at least one holder after each forming cycle, whereby said apparatus enables head forming of blanks successively introduced into said at least one holder; and, means supporting said holder plate for rotation, and a plurality of holders and clamping means associated with each holder carried by said holder plate, each holder located to be rotated into alignment with said at least one die and punch of said respective first and second tooling plates upon a predetermined increment of rotation of said holder plate, and indexing drive means causing a controlled and timed incremental rotation of said holder plate corresponding to said predetermined increment of rotation, whereby each of said plurality of holders may bring a successive blank into registry with said at least one die and punch of said respective first and second tooling plates, and wherein said feed means includes means for feeding a blank into each holder successively prior to movement thereof into registry with said at least one die and punch of said first and second tooling plates, respectively, and wherein said ejection means includes means for ejecting a formed article from a successive one of said plurality of holders after rotation past said at least one die and punch of said first and second tooling plates, respectively.

2. The apparatus according to claim 1 further including a series of dies carried by said first tooling plate, each of said dies in said series having a die forming opening; and a corresponding series of punches carried by said second tooling plate, each aligned within a die opening of a respective one of said dies in said series, each of said dies and punches located to be aligned with a successive one of said holders carried by said holder plate as said indexing means causes incremental rotation of said holder plate, each of said punches and dies relatively sized to provide a series of successive stations whereat each of said blanks is partially formed in successive steps as each of said blanks are advanced therethrough by indexing of said holder plate.

3. The apparatus according to claim 1 wherein said at least one holder and said at least one die are each formed with respective interfitting portions, each concentric with said die opening and holder opening respectively, and brought into mating engagement upon continued advancing axial movement of said first tooling plate towards said holder plate to thereby enable accurate piloting together of said die and holder openings.

4. The apparatus according to claim 2 further including resilient spacer means axially locating each of said dies with respect to said first tooling plate, to enable slight relative axial movement as each of said dies is advanced into contact with said respective holders, and causing a resilient bias of said dies into engagement therewith.

5. The apparatus according to claim 2 wherein each of said holders includes a pair of opposing halves carried by said holder plate, each half formed with a channel, and together defining said holder opening, and also including spring bias means urging said holder halves apart to widen said opening, and wherein each of said holder clamping means includes means for forcing respective holder halves together to reduce said opening diameter and enable clamping of a blank therein; and holder clamp operator means causing each of said holder clamping means to be released to enable said feeding in blanks and ejection out of formed articles respectively, and means for forcing said halves of each holder together prior to indexing of said holder plate to move each of said holders into registry with said dies and punches on said first and second tooling plates.

6. The apparatus according to claim 2 wherein the last of said punches in said series is of substantially smaller diameter than the head portion of said blank received from the previous tooling station to reverse extrude said head portion and form an endwise opening thereinto upon advance of said punch thereinto.

7. The apparatus according to claim 2 including a series of at least four successive tooling stations and wherein said dies and punches are configured to reduce the length of said headed portion by a factor substantially greater than 6.5 times the initial diameter.

8. The apparatus according to claim 1 wherein said respective means causing advance and retraction of said first and second tooling plates respectively, each includes cam means drivingly connected to said first and second tooling plates respectively and causing said advance and retraction thereof.

9. The apparatus according to claim 1 wherein said feed means includes means for advancing elongated stock material of indeterminant length received from a supply source to be inserted into said holder after each ejection cycle of said ejection means, and further includes cut-off means for severing a length of stock protruding from said holder after insertion thereof.

10. The apparatus according to claim 9 wherein said first tooling plate is formed with an opening aligned with said elongated stock advanced by said feed means wherein said feed means directs said elongated stock through said first tooling plate opening, and wherein said cut-off means includes a cut off die mounted in said opening, and also includes means for shearing off said length of stock by transversely moving said cut-off die set after said stock is inserted into said holder.

11. The apparatus according to claim 10 wherein said feed means includes stationary clamping means adjacent said first tooling plate, and operator means for intermittently operating said stationary clamping means to clamp said stock material after insertion into said holder, prior to operation of said cut-off means and wherein said holder clamp operator means causes clamping of said stock portion inserted therein prior to operation of said cut-off means.

12. The apparatus according to claim 11 wherein said feed means includes a movable carrier adapted to be advanced and retracted by means included in said feed means, said movable carrier including carrier clamping means receiving said stock from said source and carrier operator means for causing said carrier clamping means to grip said stock during advancing of said stock into said holder means, and releasing said stock material thereafter to allow return movement of said carrier.

13. The apparatus according to claim 1 wherein said feed means includes adjustable stroke means for adjusting the length of stock material fed into said holder, to thereby vary the length of the unformed portion of said formed articles.

14. The apparatus according to claim 1 including means adjustably mounting said punch in said second tooling plate to enable control over the extent of forming carried out by said punch.

15. The apparatus according to claim 2 further including detector means detecting a broken punch retained in said formed articles after passing through said stations whereat forming is carried out by said dies and punches.

16. The apparatus according to claim 2 wherein each of said holder clamp operator means includes a locking members carried by said holder plate overlying the halves of the respective holder, said members axially movable to cause said halves to be moved together, and in the other direction to allow separation by said bias means.

17. The apparatus according to claim 16 wherein said holder clamp operator means includes a yoke member having portions straddling said locking members as said holder plate rotates therebetween, and also including means for reciprocating said yoke member to produce said movement of said locking members.

18. Apparatus for forming articles from elongated blanks by heading comprising:

an axially fixed holder plate;

at least one holder carried by said holder plate having an opening adapted to receive one end of an elongated blank, said holder also including means for clamping a received blank end disposed therein;

a first tooling plate carrying a die having an opening locatable opposite said holder carried by said holder plate;

means for mounting said first tooling plate to be axially movable toward and away from said holder plate;

means for causing controlled timed advance and retraction of said first tooling plate consisting of movement of said first tooling plate towards and away from said holder plate bringing said die opening from a position remote from said holder opening to a position overlying said holder opening to create a closed end die opening with said blank protruding thereinto, said means for causing controlled advance and retraction of said first tooling plate causing an initial advance of said first tooling plate to bring said at least one die into contact with said holder;

a second tooling plate juxtaposed to said first tooling plate on a side thereof remote from said holder plate carrying at least one punch axially aligned and extending towards said at least one die opening in said first tooling plate;

means for mounting said second tooling plate for independent axial movement towards and away from said first tooling plate;

means for causing controlled timed advance and retraction of said second tooling plate comprising movement of said second tooling plate toward and away from said first tooling plate respectively to cause advance of said at least one punch into said at least one die opening to enable heading of a blank retained in said at least one holder in said at least one die opening, said means causing advance and retraction of said second tooling plate causing an advance of said second tooling plate subsequent to initiation of said advance of said first tooling plate to carry out said head forming by contact with a blank disposed in said die also causing retraction of said first tooling plate to achieve withdrawal of at least one die from said formed blank prior to withdrawal of said punch, whereby said punch may act to prevent stripping of said formed blank from said holder;

said means for causing said controlled advance and retraction of said second tooling plate also including means causing a slight retraction of said second tooling plate just prior to retraction of said first tooling plate to relieve the pressure on said formed blank;

means for successively feeding blanks into said at least one holder; and means for ejecting formed articles from said at least one holder after each forming cycle, whereby said apparatus enables head forming of blanks successively introduced into said at least one holder.

19. Apparatus for forming articles from elongated blanks by heading comprising:

an axially fixed holder plate;

at least one holder carried by said holder plate having an opening adapted to receive one end of an elongated blank, said holder also including means for clamping a received blank end disposed therein;

a first tooling plate carrying a die having an opening locatable opposite said holder carried by said holder plate;

means for mounting said first tooling plate to be axially movable toward and away from said holder plate;

means for causing controlled timed advance and retraction of said first tooling plate consisting of movement of said first tooling plate towards and away from said holder plate bringing said die opening from a position remote from said holder opening to a position overlying said holder opening to create a closed end die opening with said blank protruding thereinto;

a second tooling plate juxtaposed to said first tooling plate on a side thereof remote from said holder plate carrying at least one punch axially aligned and extending towards said at least one die opening in said first tooling plate;

means for mounting said second tooling plate for independent axial movement towards and away from said first tooling plate;

means for causing controlled timed advance and retraction of said second tooling plate comprising movement of said second tooling plate toward and away from said first tooling plate respectively to cause advance of said at least one punch into said at least one die opening to enable heading of a blank retained in said at least one holder in said at least one die opening;

means for successively feeding blanks into said at least one holder; and means for ejecting formed articles from said at least one holder after each forming cycle, whereby said apparatus enables head forming of blanks successively introduced into said at least one holder;

said at least one holder further including a recessed counterbore at the surface thereof facing said die and of a larger diameter than said die opening allowing radial expansion of a portion of said blank disposed therein to form a shoulder intermediate the length of said formed blank as said punch is advanced to head form said blank.

20. Apparatus for forming articles from elongated blanks by heading comprising:

an axially fixed holder plate;

at least one holder carried by said holder plate having an opening adapted to receive one end of an elongated blank, said holder also including means for clamping a received blank end disposed therein;

a first tooling plate carrying a die having an opening locatable opposite said holder carried by said holder plate;

means for mounting said first tooling plate to be axially movable toward and away from said holder plate;

means for causing controlled timed advance and retraction of said first tooling plate consisting of movement of said first tooling plate towards and away from said holder plate bringing said die opening from a position remote from said holder opening to a position overlying said holder opening to create a closed end die opening with said blank protruding thereinto;

a second tooling plate juxtaposed to said first tooling plate on a side thereof remote from said holder plate carrying at least one punch axially aligned and extending towards said at least one die opening in said first tooling plate;

means for mounting said second tooling plate for independent axial movement towards and away from said first tooling plate;

means for causing controlled timed advance and retraction of said second tooling plate comprising movement of said second tooling plate toward and away from said first tooling plate respectively to cause advance of said at least one punch into said at least one die opening to enable heading of a blank retained in said at least one holder in said at least one die opening;

means for successively feeding blanks into said at least one holder; and means for ejecting formed articles from said at least one holder after each forming cycle, whereby said apparatus enables head forming of blanks successively introduced into said at least one holder;

said means causing said controlled advance and retraction of said first tooling plate including an elongated extension member affixed to said first tooling plate extending away therefrom in the direction opposite from said holder plate and passing through said second tooling plate;

said means for causing said controlled advance and retraction of said second tooling plate including a hollow elongated extension member affixed to said second tooling plate and extending axially away therefrom in the direction opposite said first tooling plate, said hollow elongated extension member slidably receiving said extension member affixed to said first tooling plate, said first mentioned means including drive means drivingly connected to said extension member affixed to said first tooling plate and causing reciprocation thereof to produce said timed advance and retraction of said first tooling plate, and said second mentioned means including drive means drivingly connected to said hollow extension member and causing reciprocation thereof to produce said advance and retraction of said second tooling plate.

* * * * *